US011242983B2

(12) United States Patent
Danesh et al.

(10) Patent No.: US 11,242,983 B2
(45) Date of Patent: Feb. 8, 2022

(54) CASING FOR LIGHTING ASSEMBLY

(71) Applicant: DMF, Inc., Carson, CA (US)

(72) Inventors: Michael D. Danesh, Carson, CA (US); Xinzhi Peng, Downey, CA (US)

(73) Assignee: DMF, Inc., Carson, CA (US)

( * ) Notice: Subject to any disclaimer, the term of this patent is extended or adjusted under 35 U.S.C. 154(b) by 0 days.

(21) Appl. No.: 16/779,865

(22) Filed: Feb. 3, 2020

(65) Prior Publication Data

US 2020/0393118 A1 Dec. 17, 2020

Related U.S. Application Data

(63) Continuation of application No. 14/942,937, filed on Nov. 16, 2015, now Pat. No. 10,551,044.

(51) Int. Cl.

| | |
|---|---|
| ***F21V 23/00*** | (2015.01) |
| ***F21S 8/02*** | (2006.01) |
| ***F21V 17/18*** | (2006.01) |

(52) U.S. Cl.

CPC ..... *F21V 23/001* (2013.01); *F21S 8/02* (2013.01); *F21V 17/18* (2013.01)

(58) Field of Classification Search

CPC .... F21V 23/001; F21V 17/18; F21V 2115/10; F21V 17/12; F21V 21/04; F21V 21/041; F21V 21/047; F21V 21/048; F21V 21/049; F21S 8/02

USPC ..... 362/365

See application file for complete search history.

(56) References Cited

U.S. PATENT DOCUMENTS

| | | | |
|---|---|---|---|
| 1,133,535 | A | 3/1915 | Cain et al. |
| 1,471,340 | A | 10/1923 | Knight |
| 1,856,356 | A | 5/1932 | Owen |
| 2,038,784 | A | 4/1936 | Ghadiali |
| 2,179,161 | A | 11/1939 | Rambusch |
| 2,197,737 | A | 4/1940 | Appleton |
| 2,352,913 | A | 7/1944 | Morrill |
| 2,528,989 | A | 11/1950 | Ammells |
| 2,597,595 | A | 5/1952 | Ordas |
| 2,642,246 | A | 6/1953 | Larry |
| 2,670,919 | A | 3/1954 | Vincent |
| 2,697,535 | A | 12/1954 | Olson |
| 2,758,810 | A | 8/1956 | Good |
| D180,844 | S | 8/1957 | Poliakoff |
| 2,802,933 | A | 8/1957 | Harry |
| 2,998,512 | A | 8/1961 | Duchene et al. |
| 3,023,920 | A | 3/1962 | Cook et al. |
| 3,057,993 | A | 10/1962 | Gellert |
| 3,104,087 | A | 9/1963 | Joseph et al. |
| 3,214,126 | A | 10/1965 | Roos |

(Continued)

FOREIGN PATENT DOCUMENTS

| | | |
|---|---|---|
| CA | 2243934 C | 6/2002 |
| CA | 2502637 A1 | 9/2005 |

(Continued)

OTHER PUBLICATIONS

U.S. Appl. No. 14/713,340, filed Oct. 23, 1923, Knight.

(Continued)

*Primary Examiner* — Andrew J Coughlin
*Assistant Examiner* — Jessica M Apenteng
(74) *Attorney, Agent, or Firm* — Smith Baluch LLP

(57) ABSTRACT

A fire-resistant, recessed lighting unit that obviates the need for a separate junction box and a separate incandescent "can". Other embodiments are also described and claimed.

57 Claims, 6 Drawing Sheets

(56) References Cited

U.S. PATENT DOCUMENTS 3,422,261 A 1/1969 McGinty
3,460,299 A 8/1969 Wilson
3,650,046 A 3/1972 Skinner
3,675,807 A 7/1972 Lund et al.
3,700,885 A 10/1972 Bobrick
3,711,053 A 1/1973 Drake
D227,989 S 7/1973 Geisel
3,773,968 A 11/1973 Copp
3,812,342 A 5/1974 McNamara
3,836,766 A 9/1974 Auerbach
3,874,035 A 4/1975 Schuplin
3,913,773 A 10/1975 Copp et al.
D245,905 S 9/1977 Taylor
4,088,827 A 5/1978 Kohaut
4,154,218 A 5/1979 Hulet
4,154,219 A 5/1979 Gupta et al.
4,176,758 A 12/1979 Glick
4,280,169 A 7/1981 Allen
4,399,497 A 8/1983 Druffel
4,450,512 A 5/1984 Kristofek
4,460,948 A 7/1984 Malola
4,520,435 A 5/1985 Baldwin
4,539,629 A 9/1985 Poppenheimer
4,601,145 A 7/1986 Wilcox
4,667,840 A 5/1987 Lindsey
4,723,747 A 2/1988 Karp et al.
4,729,080 A 3/1988 Fremont et al.
4,754,377 A 6/1988 Wenman
4,770,311 A 9/1988 Wang
4,880,128 A 11/1989 Jorgensen
4,910,651 A 3/1990 Montanez
4,919,292 A 4/1990 Hsu
4,929,187 A 5/1990 Hudson et al.
4,930,054 A 5/1990 Krebs
5,044,582 A 9/1991 Walters
D326,537 S 5/1992 Gattari
5,216,203 A 6/1993 Gower
5,222,800 A 6/1993 Chan et al.
5,239,132 A 8/1993 Bartow
5,250,269 A 10/1993 Langer et al.
5,266,050 A 11/1993 O'Neil et al.
5,303,894 A 4/1994 Deschamps et al.
5,382,752 A 1/1995 Reyhan et al.
5,420,376 A 5/1995 Rajecki et al.
5,444,606 A 8/1995 Barnes et al.
5,465,199 A 11/1995 Bray et al.
5,505,419 A 4/1996 Gabrius
5,544,870 A 8/1996 Kelly et al.
5,562,343 A 10/1996 Chan et al.
5,571,993 A 11/1996 Jones et al.
5,580,158 A 12/1996 Aubrey et al.
5,588,737 A 12/1996 Kusmer
5,603,424 A 2/1997 Bordwell et al.
5,609,408 A 3/1997 Targetti
5,613,338 A 3/1997 Esposito
D381,111 S 7/1997 Lecluze
5,662,413 A 9/1997 Akiyama et al.
D386,277 S 11/1997 Lecluze
5,690,423 A 11/1997 Hentz et al.
D387,466 S 12/1997 Lecluze
5,738,436 A 4/1998 Cummings et al.
5,778,625 A 7/1998 Druffel et al.
5,836,678 A 11/1998 Wright et al.
5,942,726 A 8/1999 Reiker
5,944,412 A 9/1999 Janos et al.
5,957,573 A 9/1999 Wedekind et al.
6,082,878 A 7/2000 Doubek et al.
6,095,669 A 8/2000 Cho
6,098,945 A 8/2000 Korcz
6,105,334 A 8/2000 Monson et al.
6,161,910 A 12/2000 Reisenauer et al.
6,170,685 B1 1/2001 Currier
6,174,076 B1 1/2001 Petrakis et al.
6,176,599 B1 1/2001 Farzen
6,267,491 B1 7/2001 Parrigin
6,332,597 B1 12/2001 Korcz et al.
6,350,043 B1 2/2002 Gloisten
6,350,046 B1 2/2002 Lau
6,364,511 B1 4/2002 Cohen
6,375,338 B1 4/2002 Cummings et al.
6,402,112 B1 6/2002 Thomas et al.
D461,455 S 8/2002 Forbes
6,461,016 B1 10/2002 Jamison et al.
6,474,846 B1 11/2002 Kelmelis et al.
6,491,413 B1 12/2002 Benesohn
D468,697 S 1/2003 Straub, Jr.
D470,970 S 2/2003 Huang
6,515,313 B1 2/2003 Ibbetson et al.
6,521,833 B1 2/2003 DeFreitas
D471,657 S 3/2003 Huang
6,583,573 B2 6/2003 Bierman
6,585,389 B2 7/2003 Bonazzi
6,600,175 B1 7/2003 Baretz et al.
D478,872 S 8/2003 Heggem
6,632,006 B1 10/2003 Rippel et al.
6,657,236 B1 12/2003 Thibeault et al.
6,666,419 B1 12/2003 Vrame
D488,583 S 4/2004 Benghozi
6,719,438 B2 4/2004 Sevack et al.
6,758,578 B1 7/2004 Chou
6,777,615 B1 8/2004 Gretz
6,779,908 B1 8/2004 Ng
6,827,229 B2 12/2004 Dinh et al.
6,838,618 B2 1/2005 Newbold et al.
6,906,352 B2 6/2005 Edmond et al.
D509,314 S 9/2005 Rashidi
6,948,829 B2 9/2005 Verdes et al.
6,958,497 B2 10/2005 Emerson et al.
6,964,501 B2 11/2005 Ryan
6,967,284 B1 11/2005 Gretz
D516,235 S 2/2006 Rashidi
7,025,477 B2 4/2006 Blessing
7,064,269 B2 6/2006 Smith
D528,673 S 9/2006 Maxik et al.
7,102,172 B2 9/2006 Lynch
D531,740 S 11/2006 Maxik
D532,532 S 11/2006 Maxik
7,148,420 B1 12/2006 Johnson et al.
7,148,632 B2 12/2006 Berman et al.
7,154,040 B1 12/2006 Tompkins
7,170,015 B1 1/2007 Roesch et al.
D536,349 S 2/2007 Humber et al.
D537,039 S 2/2007 Pincek
D539,229 S 3/2007 Murphey
7,186,008 B2 3/2007 Patti
7,190,126 B1 3/2007 Paton
7,211,833 B2 5/2007 Slater, Jr. et al.
7,213,940 B1 5/2007 Van De Ven et al.
7,234,674 B2 6/2007 Rippel et al.
D547,889 S 7/2007 Huang
D552,969 S 10/2007 Bobrowski et al.
D553,267 S 10/2007 Yuen
D555,106 S 11/2007 Pape et al.
D556,144 S 11/2007 Dinh
7,297,870 B1 11/2007 Sartini
7,312,474 B2 12/2007 Emerson et al.
7,320,536 B2 1/2008 Petrakis et al.
D561,372 S 2/2008 Yan
D561,373 S 2/2008 Yan
7,335,920 B2 2/2008 Denbaars et al.
D563,896 S 3/2008 Greenslate
7,347,580 B2 3/2008 Blackman et al.
D570,012 S 5/2008 Huang
7,374,308 B2 5/2008 Sevack et al.
D570,504 S 6/2008 Maxik et al.
D570,505 S 6/2008 Maxik et al.
7,399,104 B2 7/2008 Rappaport
7,429,025 B1 9/2008 Gretz
D578,677 S 10/2008 Huang
7,431,482 B1 10/2008 Morgan et al.
7,432,440 B2 10/2008 Hull et al.
7,442,883 B2 10/2008 Jolly et al.
7,446,345 B2 11/2008 Emerson et al.
7,470,048 B2 12/2008 Wu

(56) References Cited

U.S. PATENT DOCUMENTS

| | | | |
|---|---|---|---|
| 7,473,005 | B2 | 1/2009 | O'Brien |
| 7,488,097 | B2 | 2/2009 | Reisenauer et al. |
| 7,494,258 | B2 | 2/2009 | McNaught |
| 7,503,145 | B2 | 3/2009 | Newbold et al. |
| 7,524,089 | B2 | 4/2009 | Park |
| D591,894 | S | 5/2009 | Flank |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,712,922 | B2 | 5/2010 | Hacker et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| 7,784,754 | B2 | 8/2010 | Nevers et al. |
| D624,691 | S | 9/2010 | Zhang et al. |
| D624,692 | S | 9/2010 | Mackin et al. |
| D625,847 | S | 10/2010 | Maglica |
| D625,876 | S | 10/2010 | Chen et al. |
| D627,507 | S | 11/2010 | Lai et al. |
| D627,727 | S | 11/2010 | Alexander et al. |
| 7,828,465 | B2 | 11/2010 | Roberge et al. |
| D629,366 | S | 12/2010 | Ericson et al. |
| 7,845,393 | B2 | 12/2010 | Kao et al. |
| 7,857,275 | B2 | 12/2010 | de la Borbolla |
| 7,871,184 | B2 | 1/2011 | Peng |
| 7,874,539 | B2 | 1/2011 | Wright et al. |
| 7,874,703 | B2 | 1/2011 | Shastry et al. |
| 7,874,709 | B1 | 1/2011 | Beadle |
| D633,224 | S | 2/2011 | Lee |
| 7,909,487 | B1 | 3/2011 | Venetucci et al. |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,956,546 | B2 | 6/2011 | Hasnain |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| 8,002,425 | B2 | 8/2011 | Russo et al. |
| D646,011 | S | 9/2011 | Rashidi |
| 8,013,243 | B2 | 9/2011 | Korcz et al. |
| 8,038,113 | B2 | 10/2011 | Fryzek et al. |
| D648,476 | S | 11/2011 | Choi et al. |
| D648,477 | S | 11/2011 | Kim et al. |
| D650,115 | S | 12/2011 | Kim et al. |
| 8,070,328 | B1 | 12/2011 | Knoble et al. |
| 8,096,670 | B2 | 1/2012 | Trott |
| D654,205 | S | 2/2012 | Rashidi |
| D656,262 | S | 3/2012 | Yoshinobu et al. |
| D656,263 | S | 3/2012 | Ogawa et al. |
| 8,142,057 | B2 | 3/2012 | Roos et al. |
| 8,152,334 | B2 | 4/2012 | Krogman |
| D658,788 | S | 5/2012 | Dudik et al. |
| D658,802 | S | 5/2012 | Chen |
| D659,862 | S | 5/2012 | Tsai |
| D659,879 | S | 5/2012 | Rashidi |
| D660,814 | S | 5/2012 | Wilson |
| 8,182,116 | B2 | 5/2012 | Zhang et al. |
| 8,201,968 | B2 | 6/2012 | Maxik et al. |
| D663,058 | S | 7/2012 | Pan |
| D663,466 | S | 7/2012 | Rashidi |
| D664,274 | S | 7/2012 | de Visser et al. |
| D664,705 | S | 7/2012 | Kong et al. |
| 8,215,805 | B2 | 7/2012 | Cogliano et al. |
| 8,220,970 | B1 | 7/2012 | Khazi et al. |
| 8,226,270 | B2 | 7/2012 | Yamamoto et al. |
| 8,235,549 | B2 | 8/2012 | Gingrich, III et al. |
| 8,240,630 | B2 | 8/2012 | Wronski |
| D667,155 | S | 9/2012 | Rashidi |
| 8,262,255 | B1 | 9/2012 | Rashidi |
| D668,372 | S | 10/2012 | Renshaw et al. |
| D668,809 | S | 10/2012 | Rashidi |
| D669,198 | S | 10/2012 | Qui |
| D669,199 | S | 10/2012 | Chuang |
| D669,620 | S | 10/2012 | Rashidi |
| 8,277,090 | B2 | 10/2012 | Fryzek et al. |
| D671,668 | S | 11/2012 | Rowlette, Jr. et al. |
| 8,308,322 | B2 | 11/2012 | Santiago et al. |
| D672,899 | S | 12/2012 | Ven et al. |
| D673,869 | S | 1/2013 | Yu |
| D676,263 | S | 2/2013 | Birke |
| D676,814 | S | 2/2013 | Paul |
| 8,376,593 | B2 | 2/2013 | Bazydola et al. |
| D677,417 | S | 3/2013 | Rashidi |
| D677,634 | S | 3/2013 | Korcz et al. |
| D679,044 | S | 3/2013 | Jeswani et al. |
| D679,047 | S | 3/2013 | Tickner et al. |
| 8,403,533 | B1 | 3/2013 | Paulsel |
| 8,403,541 | B1 | 3/2013 | Rashidi |
| 8,405,947 | B1 | 3/2013 | Green et al. |
| D681,259 | S | 4/2013 | Kong |
| 8,408,759 | B1 | 4/2013 | Rashidi |
| D682,459 | S | 5/2013 | Gordin et al. |
| D683,063 | S | 5/2013 | Lopez et al. |
| D683,890 | S | 6/2013 | Lopez et al. |
| D684,269 | S | 6/2013 | Wang et al. |
| D684,287 | S | 6/2013 | Rashidi |
| D684,719 | S | 6/2013 | Rashidi |
| D685,118 | S | 6/2013 | Rashidi |
| D685,120 | S | 6/2013 | Rashidi |
| 8,454,204 | B1 | 6/2013 | Chang et al. |
| D685,507 | S | 7/2013 | Sun |
| D687,586 | S | 8/2013 | Rashidi |
| D687,587 | S | 8/2013 | Rashidi |
| D687,588 | S | 8/2013 | Rashidi |
| D687,980 | S | 8/2013 | Gravely et al. |
| D688,405 | S | 8/2013 | Kim et al. |
| 8,506,127 | B2 | 8/2013 | Russello et al. |
| 8,506,134 | B2 | 8/2013 | Wilson et al. |
| D690,049 | S | 9/2013 | Rashidi |
| D690,864 | S | 10/2013 | Rashidi |
| D690,865 | S | 10/2013 | Rashidi |
| D690,866 | S | 10/2013 | Rashidi |
| D691,314 | S | 10/2013 | Rashidi |
| D691,315 | S | 10/2013 | Samson |
| D691,763 | S | 10/2013 | Hand et al. |
| 8,550,669 | B2 | 10/2013 | Macwan et al. |
| D693,043 | S | 11/2013 | Schmalfuss et al. |
| D693,517 | S | 11/2013 | Davis |
| D694,456 | S | 11/2013 | Rowlette, Jr. et al. |
| 8,573,816 | B2 | 11/2013 | Negley et al. |
| D695,441 | S | 12/2013 | Lui et al. |
| D695,941 | S | 12/2013 | Rashidi |
| D696,446 | S | 12/2013 | Huh |
| D696,447 | S | 12/2013 | Huh |
| D696,448 | S | 12/2013 | Huh |

(56) References Cited

U.S. PATENT DOCUMENTS

| | | | |
|---|---|---|---|
| 8,602,601 | B2 | 12/2013 | Khazi et al. |
| D698,067 | S | 1/2014 | Rashidi |
| D698,068 | S | 1/2014 | Rashidi |
| 8,622,361 | B2 | 1/2014 | Wronski |
| 8,632,040 | B2 | 1/2014 | Mass et al. |
| D698,985 | S | 2/2014 | Lopez et al. |
| D699,384 | S | 2/2014 | Rashidi |
| D699,687 | S | 2/2014 | Baldwin et al. |
| D700,387 | S | 2/2014 | Snell |
| 8,641,243 | B1 | 2/2014 | Rashidi |
| 8,659,034 | B2 | 2/2014 | Baretz et al. |
| D700,991 | S | 3/2014 | Johnson et al. |
| D701,175 | S | 3/2014 | Baldwin et al. |
| D701,466 | S | 3/2014 | Clifford et al. |
| 8,672,518 | B2 | 3/2014 | Boomgaarden et al. |
| D702,867 | S | 4/2014 | Kim et al. |
| D703,843 | S | 4/2014 | Cheng |
| 8,684,569 | B2 | 4/2014 | Pickard et al. |
| 8,696,158 | B2 | 4/2014 | Santiago et al. |
| D705,472 | S | 5/2014 | Huh |
| D705,481 | S | 5/2014 | Zhang et al. |
| 8,727,582 | B2 | 5/2014 | Brown et al. |
| D708,381 | S | 7/2014 | Rashidi |
| 8,777,449 | B2 | 7/2014 | Ven et al. |
| D710,529 | S | 8/2014 | Lopez et al. |
| 8,801,217 | B2 | 8/2014 | Oehle et al. |
| 8,820,985 | B1 | 9/2014 | Tam et al. |
| 8,833,013 | B2 | 9/2014 | Harman |
| 8,845,144 | B1 | 9/2014 | Davies et al. |
| D714,989 | S | 10/2014 | Rowlette, Jr. et al. |
| 8,870,426 | B2 | 10/2014 | Biebl et al. |
| 8,890,414 | B2 | 11/2014 | Rowlette, Jr. et al. |
| D721,845 | S | 1/2015 | Lui et al. |
| 8,926,133 | B2 | 1/2015 | Booth |
| 8,939,418 | B2 | 1/2015 | Green et al. |
| D722,296 | S | 2/2015 | Taylor |
| D722,977 | S | 2/2015 | Hagarty |
| D722,978 | S | 2/2015 | Hagarty |
| 8,950,898 | B2 | 2/2015 | Catalano |
| D723,781 | S | 3/2015 | Miner |
| D723,783 | S | 3/2015 | Miner |
| D725,359 | S | 3/2015 | Miner |
| 8,967,575 | B1 | 3/2015 | Gretz |
| D726,363 | S | 4/2015 | Danesh |
| D726,949 | S | 4/2015 | Redfern |
| 9,004,435 | B2 | 4/2015 | Wronski |
| 9,039,254 | B2 | 5/2015 | Danesh |
| D731,689 | S | 6/2015 | Bernard et al. |
| 9,062,866 | B1 | 6/2015 | Christ et al. |
| 9,065,264 | B2 | 6/2015 | Cooper et al. |
| 9,068,719 | B2 | 6/2015 | Van De Ven et al. |
| 9,068,722 | B2 | 6/2015 | Wronski et al. |
| D734,525 | S | 7/2015 | Gordin et al. |
| D735,012 | S | 7/2015 | Cowie |
| D735,142 | S | 7/2015 | Hagarty |
| 9,078,299 | B2 | 7/2015 | Ashdown |
| 9,109,783 | B1 | 8/2015 | Davis et al. |
| D739,355 | S | 9/2015 | D'Aubeterre |
| D739,590 | S | 9/2015 | Redfern |
| 9,140,441 | B2 | 9/2015 | Goelz et al. |
| D741,538 | S | 10/2015 | Ghasabi |
| D742,325 | S | 10/2015 | Leung |
| 9,151,457 | B2 | 10/2015 | Pickard et al. |
| 9,151,477 | B2 | 10/2015 | Pickard et al. |
| D743,079 | S | 11/2015 | Adair |
| D744,723 | S | 12/2015 | Yoo |
| 9,217,560 | B2 | 12/2015 | Harbers et al. |
| 9,222,661 | B2 | 12/2015 | Kim et al. |
| 9,239,131 | B1 | 1/2016 | Wronski et al. |
| D750,317 | S | 2/2016 | Lui et al. |
| 9,285,103 | B2 | 3/2016 | Van De Ven et al. |
| 9,291,319 | B2 | 3/2016 | Kathawate et al. |
| 9,301,362 | B2 | 3/2016 | Dohn et al. |
| D754,078 | S | 4/2016 | Baldwin et al. |
| D754,079 | S | 4/2016 | Baldwin et al. |
| D754,605 | S | 4/2016 | McMillan |
| 9,303,812 | B2 | 4/2016 | Green et al. |
| 9,310,038 | B2 | 4/2016 | Athalye |
| 9,322,543 | B2 | 4/2016 | Hussell et al. |
| 9,347,655 | B2 | 5/2016 | Boomgaarden et al. |
| 9,366,418 | B2 | 6/2016 | Gifford |
| 9,371,966 | B2 | 6/2016 | Rowlette, Jr. et al. |
| D762,181 | S | 7/2016 | Lin |
| 9,395,051 | B2 | 7/2016 | Hussell et al. |
| D762,906 | S | 8/2016 | Jeswani et al. |
| D764,079 | S | 8/2016 | Wu |
| 9,404,639 | B2 | 8/2016 | Bailey et al. |
| 9,417,506 | B1 | 8/2016 | Tirosh |
| 9,423,110 | B1 | 8/2016 | Newton et al. |
| D766,185 | S | 9/2016 | Hagarty |
| D767,199 | S | 9/2016 | Wronski et al. |
| 9,447,917 | B1 | 9/2016 | Wronski et al. |
| 9,447,953 | B2 | 9/2016 | Lawlor |
| D768,325 | S | 10/2016 | Xu |
| D768,326 | S | 10/2016 | Guzzini |
| D769,501 | S | 10/2016 | Jeswani et al. |
| D770,065 | S | 10/2016 | Tittle |
| D770,076 | S | 10/2016 | Li et al. |
| 9,476,552 | B2 | 10/2016 | Myers et al. |
| D774,676 | S | 12/2016 | Ng |
| D776,324 | S | 1/2017 | Gierl et al. |
| D777,967 | S | 1/2017 | Redfern |
| 9,534,751 | B2 | 1/2017 | Maglica et al. |
| D778,241 | S | 2/2017 | Holbrook et al. |
| D778,484 | S | 2/2017 | Guzzini |
| D779,100 | S | 2/2017 | Redfern |
| 9,581,302 | B2 | 2/2017 | Danesh |
| 9,599,315 | B1 | 3/2017 | Harpenau et al. |
| 9,605,842 | B1 | 3/2017 | Davis |
| 9,605,910 | B2 | 3/2017 | Swedberg et al. |
| D785,228 | S | 4/2017 | Guzzini |
| D786,472 | S | 5/2017 | Redfern |
| D786,473 | S | 5/2017 | Dean |
| D786,474 | S | 5/2017 | Fujisawa |
| D788,330 | S | 5/2017 | Johnson et al. |
| D790,102 | S | 6/2017 | Guzzini |
| 9,673,597 | B2 | 6/2017 | Lee |
| 9,689,541 | B2 | 6/2017 | Wronski |
| D791,709 | S | 7/2017 | Holton |
| D791,711 | S | 7/2017 | Holton |
| D791,712 | S | 7/2017 | Holton |
| 9,696,021 | B2 | 7/2017 | Wronski |
| 9,702,516 | B1 | 7/2017 | Vasquez et al. |
| D795,820 | S | 8/2017 | Wengreen |
| 9,732,904 | B1 | 8/2017 | Wronski |
| 9,732,947 | B1 | 8/2017 | Christ et al. |
| 9,739,464 | B2 | 8/2017 | Wronski |
| D799,105 | S | 10/2017 | Eder et al. |
| D800,957 | S | 10/2017 | Eder et al. |
| 9,791,111 | B1 | 10/2017 | Huang et al. |
| 9,797,562 | B2 | 10/2017 | Dabiet et al. |
| 9,803,839 | B2 | 10/2017 | Visser et al. |
| D805,660 | S | 12/2017 | Creasman et al. |
| D809,176 | S | 1/2018 | Partington |
| 9,860,961 | B2 | 1/2018 | Chemel et al. |
| 9,863,619 | B2 | 1/2018 | Mak |
| D809,465 | S | 2/2018 | Keirstead |
| 9,903,569 | B2 | 2/2018 | O'Brien et al. |
| 9,964,266 | B2 | 5/2018 | Danesh |
| D820,494 | S | 6/2018 | Cohen |
| D821,615 | S | 6/2018 | Trice |
| D821,627 | S | 6/2018 | Ko |
| 9,995,441 | B2 | 6/2018 | Power et al. |
| D822,505 | S | 7/2018 | Gibson et al. |
| D824,494 | S | 7/2018 | Martins et al. |
| D825,829 | S | 8/2018 | Guo |
| 10,041,638 | B2 | 8/2018 | Vasquez et al. |
| 10,054,274 | B2 | 8/2018 | Athalye et al. |
| D827,903 | S | 9/2018 | Wu |
| D832,218 | S | 10/2018 | Wronski et al. |
| D833,977 | S | 11/2018 | Danesh et al. |
| 10,125,959 | B2 | 11/2018 | Cohen |
| 10,139,059 | B2 | 11/2018 | Danesh |
| D836,976 | S | 1/2019 | Reese et al. |

(56) References Cited

U.S. PATENT DOCUMENTS

D847,414 S 4/2019 Danesh et al.
D847,415 S 4/2019 Danesh et al.
10,247,390 B1 4/2019 Kopitzke et al.
D848,375 S 5/2019 Danesh et al.
10,281,131 B2 5/2019 Cohen
10,295,163 B1 5/2019 Cohen
D850,695 S 6/2019 Dabiet et al.
D851,046 S 6/2019 Peng et al.
10,408,395 B2 9/2019 Danesh
10,408,396 B2 9/2019 Wronski et al.
10,408,436 B2 9/2019 Wronski et al.
D863,661 S 10/2019 Tian et al.
D864,877 S 10/2019 Danesh et al.
D867,653 S 11/2019 Gorman
10,488,000 B2 11/2019 Danesh et al.
10,551,044 B2 2/2020 Peng et al.
10,563,850 B2 2/2020 Danesh
10,591,120 B2 3/2020 Bailey et al.
D880,733 S 4/2020 Lo et al.
D883,562 S 5/2020 Hu
D885,648 S 5/2020 Zeng
D885,649 S 5/2020 Mclaughlin, III et al.
10,663,127 B2 5/2020 Danesh et al.
10,663,153 B2 5/2020 Nikooyan et al.
D888,313 S 6/2020 Xie et al.
10,683,994 B2 6/2020 Wronski et al.
10,684,003 B2 6/2020 Wronski et al.
D890,410 S 7/2020 Stanford et al.
10,704,745 B2 7/2020 Sherry et al.
10,753,558 B2 8/2020 Danesh
10,808,917 B2 10/2020 Harris et al.
10,816,148 B2 10/2020 Danesh
D901,398 S 11/2020 Danesh et al.
D901,745 S 11/2020 Yang
D902,871 S 11/2020 Danesh et al.
D903,605 S 12/2020 Danesh et al.
D905,327 S 12/2020 Williams et al.
D907,284 S 1/2021 Danesh et al.
10,975,570 B2 4/2021 Shen
10,982,829 B2 4/2021 Danesh
11,022,259 B2 6/2021 Bailey et al.
11,028,982 B2 6/2021 Danesh
11,047,538 B2 6/2021 Danesh et al.
D924,467 S 7/2021 Danesh et al.
D925,109 S 7/2021 Danesh et al.
11,060,705 B1 7/2021 Danesh et al.
11,067,231 B2 7/2021 Lotfi et al.
11,085,597 B2 8/2021 Danesh
2002/0172047 A1 11/2002 Ashley
2003/0006353 A1 1/2003 Dinh et al.
2003/0016532 A1 1/2003 Reed
2003/0021104 A1 1/2003 Tsao
2003/0161153 A1 8/2003 Patti
2004/0001337 A1 1/2004 Defouw et al.
2004/0120141 A1 6/2004 Beadle
2004/0156199 A1 8/2004 Rivas et al.
2005/0078474 A1 4/2005 Whitfield
2005/0225966 A1 10/2005 Hartmann et al.
2005/0227536 A1 10/2005 Gamache et al.
2005/0231962 A1 10/2005 Koba et al.
2005/0237746 A1 10/2005 Yiu
2006/0005988 A1 1/2006 Jorgensen
2006/0158873 A1 7/2006 Newbold et al.
2006/0198126 A1 9/2006 Jones
2006/0215408 A1 9/2006 Lee
2006/0221620 A1 10/2006 Thomas
2006/0237601 A1 10/2006 Rinderer
2006/0243877 A1 11/2006 Rippel
2006/0250788 A1 11/2006 Hodge et al.
2006/0262536 A1 11/2006 Nevers
2006/0262545 A1 11/2006 Piepgras et al.
2007/0012847 A1 1/2007 Tai
2007/0035951 A1 2/2007 Tseng
2007/0121328 A1 5/2007 Mondloch et al.
2007/0131827 A1 6/2007 Nevers et al.
2007/0185675 A1 8/2007 Papamichael et al.
2007/0200039 A1 8/2007 Petak
2007/0206374 A1 9/2007 Petrakis et al.
2008/0002414 A1 1/2008 Miletich et al.
2008/0112168 A1 5/2008 Pickard et al.
2008/0112170 A1 5/2008 Trott
2008/0112171 A1 5/2008 Patti et al.
2008/0130308 A1 6/2008 Behr et al.
2008/0137347 A1 6/2008 Trott et al.
2008/0165545 A1 7/2008 O'Brien
2008/0170404 A1 7/2008 Steer et al.
2008/0224008 A1 9/2008 Dal Ponte et al.
2008/0232116 A1 9/2008 Kim
2008/0247181 A1 10/2008 Dixon
2008/0285271 A1 11/2008 Roberge et al.
2009/0003009 A1 1/2009 Tessnow et al.
2009/0034261 A1 2/2009 Grove
2009/0080189 A1 3/2009 Wegner
2009/0086484 A1 4/2009 Johnson
2009/0097262 A1 4/2009 Zhang et al.
2009/0135613 A1 5/2009 Peng
2009/0141500 A1 6/2009 Peng
2009/0141506 A1 6/2009 Lan et al.
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2009/0283292 A1 11/2009 Lehr
2009/0290343 A1 11/2009 Brown et al.
2010/0014282 A1 1/2010 Danesh
2010/0033095 A1 2/2010 Sadwick
2010/0061108 A1 3/2010 Zhang et al.
2010/0110690 A1 5/2010 Hsu et al.
2010/0110698 A1 5/2010 Harwood et al.
2010/0110699 A1 5/2010 Chou
2010/0148673 A1 6/2010 Stewart et al.
2010/0149822 A1 6/2010 Cogliano et al.
2010/0165643 A1 7/2010 Russo et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0277905 A1 11/2010 Janik et al.
2010/0284185 A1 11/2010 Ngai
2010/0302778 A1 12/2010 Dabiet et al.
2010/0328956 A1 12/2010 Zhang
2011/0043040 A1 2/2011 Porter et al.
2011/0063831 A1 3/2011 Cook
2011/0068687 A1 3/2011 Takahasi et al.
2011/0069499 A1 3/2011 Trott et al.
2011/0080750 A1 4/2011 Jones et al.
2011/0116276 A1 5/2011 Okamura et al.
2011/0121756 A1 5/2011 Thomas et al.
2011/0134634 A1 6/2011 Gingrich, III et al.
2011/0134651 A1 6/2011 Berman
2011/0140633 A1 6/2011 Archenhold
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 11/2011 Bazydola et al.
2011/0285314 A1 11/2011 Carney et al.
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0140465 A1 6/2012 Rowlette, Jr. et al.
2012/0162994 A1 6/2012 Wasniewski et al.
2012/0182744 A1 7/2012 Santiago et al.
2012/0188762 A1 7/2012 Joung et al.
2012/0243237 A1 9/2012 Toda et al.
2012/0250321 A1 10/2012 Blincoe et al.
2012/0266449 A1 10/2012 Krupa
2012/0268688 A1 10/2012 Sato et al.
2012/0287625 A1 11/2012 Macwan et al.
2012/0305868 A1 12/2012 Callahan et al.

(56) References Cited

U.S. PATENT DOCUMENTS

| | | | |
|---|---|---|---|
| 2012/0314429 | A1 | 12/2012 | Plunk |
| 2013/0009552 | A1 | 1/2013 | Page |
| 2013/0010476 | A1 | 1/2013 | Pickard et al. |
| 2013/0016864 | A1 | 1/2013 | Ivey et al. |
| 2013/0033872 | A1 | 2/2013 | Randolph et al. |
| 2013/0051012 | A1 | 2/2013 | Oehle et al. |
| 2013/0077307 | A1 | 3/2013 | Yamamoto |
| 2013/0083529 | A1 | 4/2013 | Gifford |
| 2013/0141913 | A1 | 6/2013 | Sachsenweger |
| 2013/0155681 | A1 | 6/2013 | Nall et al. |
| 2013/0163254 | A1 | 6/2013 | Chang et al. |
| 2013/0170232 | A1 | 7/2013 | Park et al. |
| 2013/0170233 | A1 | 7/2013 | Nezu et al. |
| 2013/0227908 | A1 | 9/2013 | Gulbrandsen et al. |
| 2013/0258677 | A1 | 10/2013 | Fryzek et al. |
| 2013/0265750 | A1 | 10/2013 | Pickard et al. |
| 2013/0271989 | A1 | 10/2013 | Hussell et al. |
| 2013/0294084 | A1 | 11/2013 | Kathawate et al. |
| 2013/0301252 | A1 | 11/2013 | Hussell et al. |
| 2013/0322062 | A1 | 12/2013 | Danesh |
| 2013/0322084 | A1 | 12/2013 | Ebisawa |
| 2013/0335980 | A1 | 12/2013 | Nakasuji et al. |
| 2014/0029262 | A1 | 1/2014 | Maxik et al. |
| 2014/0036497 | A1 | 2/2014 | Hussell et al. |
| 2014/0049957 | A1 | 2/2014 | Goelz et al. |
| 2014/0063776 | A1 | 3/2014 | Clark et al. |
| 2014/0071679 | A1 | 3/2014 | Booth |
| 2014/0071687 | A1 | 3/2014 | Tickner et al. |
| 2014/0140490 | A1 | 5/2014 | Roberts et al. |
| 2014/0063818 | A1 | 6/2014 | Randolph et al. |
| 2014/0233246 | A1 | 8/2014 | Lafreniere et al. |
| 2014/0254177 | A1 | 9/2014 | Danesh |
| 2014/0268836 | A1 | 9/2014 | Thompson |
| 2014/0268869 | A1 | 9/2014 | Blessitt et al. |
| 2014/0299730 | A1 | 10/2014 | Green et al. |
| 2014/0313775 | A1 | 10/2014 | Myers et al. |
| 2014/0321122 | A1 | 10/2014 | Domagala et al. |
| 2014/0347848 | A1 | 11/2014 | Pisavadia et al. |
| 2015/0009676 | A1 | 1/2015 | Danesh |
| 2015/0029732 | A1 | 1/2015 | Hatch |
| 2015/0078008 | A1 | 3/2015 | He |
| 2015/0085500 | A1 | 3/2015 | Cooper et al. |
| 2015/0138779 | A1 | 5/2015 | Livesay et al. |
| 2015/0184837 | A1 | 7/2015 | Zhang et al. |
| 2015/0198324 | A1 | 7/2015 | O'Brien et al. |
| 2015/0219317 | A1 | 8/2015 | Gatof et al. |
| 2015/0233556 | A1 | 8/2015 | Danesh |
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0084488 | A1 | 3/2016 | Wu et al. |
| 2016/0209007 | A1 | 7/2016 | Belmonte et al. |
| 2016/0238225 | A1 | 8/2016 | Doust |
| 2016/0308342 | A1 | 10/2016 | Witherbee et al. |
| 2016/0312987 | A1 | 10/2016 | Danesh |
| 2016/0348860 | A1 | 12/2016 | Bailey et al. |
| 2016/0348861 | A1 | 12/2016 | Bailey et al. |
| 2016/0366738 | A1 | 12/2016 | Boulanger et al. |
| 2017/0003007 | A1 | 1/2017 | Wronski |
| 2017/0045213 | A1 | 2/2017 | Williams et al. |
| 2017/0059135 | A1 | 3/2017 | Jones |
| 2017/0138576 | A1 | 5/2017 | Peng et al. |
| 2017/0138581 | A1 | 5/2017 | Doust |
| 2017/0167672 | A1 | 6/2017 | Stauner et al. |
| 2017/0167699 | A1 | 6/2017 | Schubert et al. |
| 2017/0198896 | A1 | 7/2017 | May |
| 2017/0284616 | A1 | 10/2017 | Coakley et al. |
| 2017/0307188 | A1 | 10/2017 | Oudina et al. |
| 2017/0307198 | A1 | 10/2017 | Shah et al. |
| 2018/0112857 | A1 | 4/2018 | Wronski et al. |
| 2018/0142871 | A1 | 5/2018 | Morales |
| 2018/0216809 | A1 | 8/2018 | Cohen |
| 2018/0224095 | A1 | 8/2018 | Cohen |
| 2018/0283677 | A1 | 10/2018 | Cohen |
| 2019/0032874 | A1 | 1/2019 | Bonnetto et al. |
| 2019/0041050 | A1 | 2/2019 | Cairns et al. |
| 2019/0049080 | A1 | 2/2019 | Danesh |
| 2019/0063701 | A1 | 2/2019 | Lotfi et al. |
| 2019/0093836 | A1 | 3/2019 | Danesh |
| 2020/0182420 | A1 | 6/2020 | Cohen et al. |
| 2020/0291652 | A1 | 9/2020 | Shen |
| 2020/0355334 | A1 | 11/2020 | Shen et al. |
| 2020/0393118 | A1 | 12/2020 | Danesh et al. |
| 2021/0010647 | A1 | 1/2021 | Danesh et al. |
| 2021/0010663 | A1 | 1/2021 | Nikooyan et al. |
| 2021/0033268 | A1 | 2/2021 | Danesh |
| 2021/0080084 | A1 | 3/2021 | Danesh et al. |
| 2021/0222845 | A1 | 7/2021 | Kopitzke et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 101498411 | B | 11/2013 |
| CN | 203273663 | U | 11/2013 |
| CN | 203297980 | U | 11/2013 |
| CN | 203628464 | U | 12/2013 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 206130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |

(56) References Cited

FOREIGN PATENT DOCUMENTS

| | | | |
|---|---|---|---|
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 9/2016 |

OTHER PUBLICATIONS

"Advanced LED Solutions," Imtra Marine Lighting. Jun. 17, 2011. 39 pages.
"Cree LMH2 LED Module with TrueWhite Technology," Cree Product Family Data Sheet. Dec. 21, 2011. 3 pages.
"Cree LMH2 LED Modules Design Guide," Cree Product Design Guide. 2011. 20 pages.
"Cree LMH2 LED Modules," Mouser Electronics. Accesssed at www.mouser.com/new/cree/creelmh2 on Sep. 9, 2012. 2 pages.
"LED Undercabinet Pocket Guide," ELCO Lighting. Nov. 2, 2016. 12 pages.
"Membrane Penetrations in Fire-Resistance Rated Walls," https://www.ul.com/wp-content/uploads/2014/04/ul_MembranePenetrations.pdf, Issue 1, 2009, published Feb. 26, 2010, 2 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
"Metallic Outlet Boxes," UL 514A, Underwriters Laboratories, Inc., Feb. 16, 2004 (Title Page Reprinted Aug. 10, 2007), 106 pages.
"Outlet Boxes for Use in Fire Rated Assemblies," https://www.ul.com/wp-content/uploads/2014/04/Ul_outletboxes.pdf, Apr. 2007, 2 pages.
"Portland Bi-Color, Warm White/Red," item:ILIM30941.Imtra Marine Products. 2012. 3 pages. Accessed athttp://www.imtra.com:80/0ade25fb-3218-4cae-a926-6abe64ffd93a/lighting-light-fixtures-downlights-3-to-4-inches-detail.htm on Jan. 25, 2013.
"Undercabinet Pucks, Xyris Mini LED Puck Light," ELCO Lighting. Sep. 2018. 1 page.
"VERSI LED Mini Flush," Lithonia Lghting. Sep. 2013. 6 pages.
<https://www.zhagastandard.org/books/book18/>, Mar. 2017, 5 pages. Accessed on May 14, 2018.
2006 International Building Code, Section 712 Penetrations, Jan. 2006, 4 pages.
3 & 4" DLE Ser ies LED Sample Case Now Available. DMF Light. Issued Jan. 6, 2012. 1 page.
4" Octagon Concrete Boxes and Back Plates. Appleton. Accessed at www.appletonelec.com on May 6, 2019. 1 page.
Acrich COB Zhaga Module, Product Description, Seoul Semiconductor, Nov. 11, 2016, 39 pages.
Be seen in the best light. Lightolier by signify. Comprehensive 2019 Lighting Catalog. 114 pages.
BXUV.GuideInfo, Fire Resistance Ratings—ANSI/UL 263, UL Online Certifications Directory, last updated Nov. 3, 2016, 27 pages.
Canadian Office Action dated Aug. 11, 2017 from Canadian Application No. 2,941,051, 4 pages.
Canadian Office Action dated Dec. 23, 2013 from Canadian Application No. 2,778,581, 3 pages.
Canadian Office Action dated Dec. 6, 2016 from Canadian Application No. 2,879,629, 3 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Mar. 22, 2016 from Canadian Application No. 2,879,629, 4 pages.
Canadian Office Action dated Mar. 9, 2017 from Canadian Application No. 2,931,588, 5 pages.
CEYY.GuideInfo, Outlet Boxes and Fittings Certified for Fire Resistance, UL Online Certifications Directory, last updated May 16, 2016, 2 pages.
Cooper Lighting HALO ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
Corrected Notice of Allowance dated Oct. 10, 2019 from U.S. Appl. No. 16/016,040, 2 pages.
Corrected Notice of Allowance dated Sep. 27, 2019 from U.S. Appl. No. 15/167,682 , 2 pages.
Cree LED Lamp Family Sales Sheet—Better light is beautiful light , Apr. 24, 2017, 2 pages.
Cree® LMR2 LED Module. Product Family Data Sheet Cree 2011. 3 pages.
CS&E PCT Collaborative Search and Examination Pilot Upload Peer Contribution in International Patent Application No. PCT/US18/62868 dated Mar. 14, 2019, 61 pages.
CS&E PCT Collaborative Search and Examination Pilot Upload Peer Contribution in International Patent Application No. PCT/US18/67614 dated Apr. 24, 2019, 53 pages.
Delhi Rehab & Nursing Facility ELM16-70884. Vertex Innovative Solutions Feb. 25, 2016. 89 pages.
DLEI3 3" Recessed LED New Construction, IC. DMF Light. Issued Nov. 30, 2011. 2 pages.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
DLER411 4" Recessed LED Retrofit Module. DMF Light. Issued Jun. 15, 2011. 1 page.
DME Series Installation Instructions, Oct. 18, 2011, 2 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
DMF, Inc., "dmfLIGHTING: LED Recessed Lighting Solutions," Info sheets, Mar. 15, 2012, 4 pages.
Ex-Parte Quayle Action mailed Jun. 27, 2019 from U.S. Appl. No. 29/683,730, 5 pages.
Final Office Action dated Apr. 2, 2015 from U.S. Appl. No. 13/484,901, 13 pages.
Final Office Action dated Apr. 27, 2016 from U.S. Appl. No. 14/184,601, 19 pages.
Final Office Action dated Jan. 29, 2016 from U.S. Appl. No. 14/183,424, 21 pages.
Final Office Action dated Jul. 26, 2017 from U.S. Appl. No. 14/184,601, 18 pages.
Final Office Action dated Jun. 23, 2016 from U.S. Appl. No. 13/484,901, 18 pages.
Final Office Action dated Jun. 6, 2019 from U.S. Appl. No. 15/688,266, 7 pages.
Final Office Action dated Mar. 15, 2019 from U.S. Appl. No. 15/132,875, 15 pages.
Final Office Action dated Mar. 17, 2020 for U.S. Appl. No. 29/653,142, 13 pages.
Final Office Action dated Oct. 3, 2019 from U.S. Appl. No. 29/678,482, 6 pages.
Final Office Action dated Sep. 27, 2019 from U.S. Appl. No. 16/200,393, 34 pages.
HALO, H7 LED Downlight Trims 49x Series, 6-inch LED Trims for Use with MI7x LED Modules, Cooper Lighting, ADV110422, rev. Aug. 12, 2011, 15 pages.
HALO, HALO LED H4 H7 Collection, SustainabLEDesign, Cooper Lighting, (emphasis on p. 18 "H7 Collection LED Modules—Halo LED H7 Module Features,") Mar. 28, 2012, 52 pages.
HALO, LED Module ML706x, Cooper Lighting, General Installation for All Modules/p. 1; Tether Installation/pp. 2-3; Installation into HALO H750x Series LED—only (Non-Screw Based), Recessed Fixture, p. 4, Oct. 20, 2009, 4 pages.
IC1JB Housing 4" IC-Rated New Construction Junction Box Housing. AcuityBrands. Accessed at https://www.acuitybrands.com/en/

(56) References Cited

OTHER PUBLICATIONS products/detail/845886/juno/ic1jb-housing/4-ic-rated-new-construction-junction-box-housing on Jun. 27, 2019.
Imtra Marine Lighting 2008 Catalog. 40 pages.
Imtra Marine Lighting 2009 Catalog. 32 pages.
Imtra Marine Lighting Spring 2007 Catalog. 36 pages.
International Search Report and Written Opinion in International Patent Application No. PCT/US18/39048 dated Dec. 14, 2018. 24 pages.
International Search Report and Written Opinion in International Patent Application No. PCT/US18/62868 dated Mar. 14, 2019, 13 pages.
International Search Report and Written Opinion in International Patent Application No. PCT/US18/67614 dated Apr. 25, 2019, 20 pages.
International Search Report and Written Opinion in International Patent Application No. PCT/US19/32281 dated Aug. 2, 2019, 19 pages.
International Search Report and Written Opinion in International Patent Application No. PCT/US2019/036477 dated Oct. 17, 2019, 15 pages.
International Search Report and Written Opinion in International Patent Application No. PCT/US2019/054220 dated Feb. 24, 2020, 23 pages.
International Search Report and Written Opinion in PCT/US2018/048357 dated Nov. 14, 2018, 13 pages.
KWIKBRACE@ New Construction Braces for Lighting Fixtures or Ceiling Fans 1½ in. Depth. Hubbel. Accessed at https://hubbellcdn.com/specsheet/926.pdf on Jun. 27, 2019. 1 page.
LED Book Pr ice Guide 2012. DMF Light. Issued Jun. 26, 2013. 3 pages.
Maxim Convert Fixture. LMXCAT1805 Maxim Main Catalog 2018 p. 639.
Maxim Lighting Trim Trifold LMXBRO1905 2019. Accessed at https://www.maximlighting.com/Upload/download/brochure/pdf/LMXBRO1905.pdf on Feb. 13, 2020. 2 pages.
Maxim Lighting Wafer Trifold Brochure LMXBRO1711 2017. Accessed at https://www.maximlighting.com/Upload/download/brochure/pdf/LMXBRO1711.pdf on Feb. 13, 2020. 2 pages.
Maxim Wafer. LMXCAT1805 Maxim Main Catalog 2018 pp. 636-638.
ML56 LED Lighting System 600 / 900 / 1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Non-Final Office Action dated Apr. 12, 2018 for U.S. Appl. No. 29/638,259, 5 pages.
Non-Final Office Action dated Apr. 2, 2020 for U.S. Appl. No. 16/522,275, 21 pages.
Non-Final Office Action dated Apr. 30, 2010 from U.S. Appl. No. 12/173,232, 13 pages.
Non-Final Office Action dated Apr. 4, 2019 from U.S. Appl. No. 29/678,482, 8 pages.
Non-Final Office Action dated Dec. 15, 2016 from U.S. Appl. No. 14/184,601, 18 pages.
Non-Final Office Action dated Dec. 30, 2019 from U.S. Appl. No. 16/653,497, 8 pages.
Non-Final Office Action dated Dec. 5, 2018 from U.S. Appl. No. 14/942,937, 13 pages.
Non-Final Office Action dated Febraury 7, 2019 from U.S. Appl. No. 16/200,393, 32 pages.
Non-Final Office Action dated Feb. 6, 2018 from U.S. Appl. No. 15/167,682, 9 pages.
Non-Final Office Action dated Jul. 20, 2015 from U.S. Appl. No. 14/184,601, 16 pages.
Non-Final Office Action dated Jul. 24, 2018 from U.S. Appl. No. 29/638,259, 5 pages.
Non-Final Office Action dated Jun. 11, 2019 from U.S. Appl. No. 15/901,738, 6 pages.
Non-Final Office Action dated Jun. 2, 2015 from U.S. Appl. No. 14/183,424, 20 pages.
Non-Final Office Action dated Jun. 25, 2018 for U.S. Appl. No. 29/541,565, 10 pages.
Non-Final Office Action dated Mar. 15, 2010 from U.S. Appl. No. 12/100,148, 8 pages.
Non-Final Office Action dated May 16, 2018 for U.S. Appl. No. 15/132,875, 18 pages.
Non-Final Office Action dated May 17, 2017 from U.S. Appl. No. 14/183,424, 20 pages.
Non-Final Office Action dated Oct. 16, 2014 from U.S. Appl. No. 13/484,901, 11 pages.
Non-Final Office Action dated Oct. 24, 2018 for U.S. Appl. No. 15/688,266, 14 pages.
Non-Final Office Action dated Sep. 15, 2015 from U.S. Appl. No. 13/484,901, 16 pages.
Non-Final Office Action dated Sep. 5, 2014 from U.S. Appl. No. 13/791,087, 8 pages.
Non-Final Office Action dated Sep. 6, 2017 from U.S. Appl. No. 14/726,064, 8 pages.
Notice of Allowance dated Apr. 1, 2019 from U.S. Appl. No. 15/167,682, 7 pages.
Notice of Allowance dated Apr. 17, 2019 from U.S. Appl. No. 29/678,478, 7 pages.
Notice of Allowance dated Apr. 8, 2019 from U.S. Appl. No. 29/653,142, 8 pages.
Notice of Allowance dated Aug. 23, 2017 from Canadian Application No. 2,879,629, 1 page.
Notice of Allowance dated Feb. 15, 2019 from U.S. Appl. No. 15/947,065 , 9 pages.
Notice of Allowance dated Feb. 5, 2020 from U.S. Appl. No. 15/901,738 , 8 pages.
Notice of Allowance dated Feb. 5, 2020 from U.S. Appl. No. 29/678,482 , 13 pages.
Notice of Allowance dated Feb. 8, 2019 from U.S. Appl. No. 29/541,565, 5 pages.
Notice of Allowance dated Jan. 16, 2015 from U.S. Appl. No. 29/467,026, 9 pages.
Notice of Allowance dated Jan. 2, 2019 from U.S. Appl. No. 29/541,565, 6 pages.
Notice of Allowance dated Jan. 28, 2019 from U.S. Appl. No. 29/664,471, 8 pages.
Notice of Allowance dated Jan. 30, 2015 from U.S. Appl. No. 13/791,087, 9 pages.
Notice of Allowance dated Jul. 31, 2019 from U.S. Appl. No. 15/167,682 , 7 pages.
Notice of Allowance dated Jun. 12, 2019 from U.S. Appl. No. 16/016,040, 8 pages.
Notice of Allowance dated Mar. 24, 2016 from U.S. Appl. No. 14/247,149, 8 pages.
Notice of Allowance dated Mar. 26, 2018 for U.S. Appl. No. 14/184,601, 10 pages.
Notice of Allowance dated May 10, 2018 from U.S. Appl. No. 14/726,064, 7 pages.
Notice of Allowance dated May 22, 2018 from U.S. Appl. No. 14/183,424, 9 pages.
Notice of Allowance dated Nov. 27,2018 from U.S. Appl. No. 15/167,682, 11 pages.
Notice of Allowance dated Oct. 1, 2019 from U.S. Appl. No. 14/942,937, 7 pages.
Notice of Allowance dated Oct. 16, 2019 from U.S. Appl. No. 15/132,875, 12 pages.
Notice of Allowance dated Oct. 21, 2016 from U.S. Appl. No. 13/484,901, 7 pages.
Notice of Allowance dated Oct. 4, 2018 from U.S. Appl. No. 15/947,065 , 9 pages.
Notice of Allowance dated Oct. 9, 2018 from U.S. Appl. No. 29/653,142, 7 pages.
Notice of Allowance dated Sep. 11, 2019 from U.S. Appl. No. 29/653,142, 6 pages.
Notice of Allowance dated Sep. 19, 2018 from U.S. Appl. No. 15/167,682 , 7 pages.

(56) References Cited

OTHER PUBLICATIONS

Notice of Allowance dated Sep. 19, 2019 from U.S. Appl. No. 16/016,040, 7 pages.
Notice of Allowance dated Sep. 21, 2018 from U.S. Appl. No. 29/645,941, 5 pages.
OneFrame Recessed LED Downlight. Dmflighting.com. Published Jun. 6, 2018. Retrieved at https://www.dmflighting.com/product/oneframe on Jun. 6, 2018. 11 pages.
RACO 4 in. Octagon Welded Concrete Ring, 3½ in. Deep with ½ and ¾ in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with ½ and ¾ in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
RACO Commercial, Industrial and Residential Electrical Products. Hubbell. Accessed at www.Hubbell-RTB.com on May 6, 2019. 356 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
SlimSurface surface mount downlighting. Philips Lightolier 2018. 8 pages.
Specification & Features 4" Octagonal Concrete Box Covers. Orbit Industries, Inc. Accessed at https://www.orbitelectric.com on May 6, 2019. 1 page.
Supplemental Notice of Allowance dated Aug. 5, 2019 from U.S. Appl. No. 15/947,065, 2 pages.
Switch and Outlet Boxes and Covers Brochure. Appelton 2010. 77 pages.
RACO 4 i+A882:C958n. Octagon Welded Concrete Ring, 3½ in. Deep with ½ and ¾ in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
Notice of Allowance dated May 18, 2020 from U.S. Appl. No. 15/901,738 , 7 pages.
Non-Final Office Action dated May 20, 2020 for U.S. Appl. No. 15/688,266, 6 pages.
Non-Final Office Action dated May 26, 2020 for U.S. Appl. No. 16/719,361, 10 pages.
Maxim Lighting International, "Wafer LED 7" RD 3000K Wall/Flush Mount", undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22,2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. :: 20870LEDD-WH/ACR Infinite Specification Sheet. Access Lighting. Apr. 9, 2020. 1 page.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: Dec. 18, 2015 Downloaded Jul. 28, 2018, from https://www.a lconlighting.com/specsheets/DMF/DRD2-Junction-Box-Retrofit-Spec-Sheet .pdf, 6 pages.
Dmf DRD2 Recessed LED Downlight General New Construction 4", 5", 6" Aperture Dated: Aug. 31, 2016 Downloaded Jul. 28, 2018, from https://www. cansandfans.com/sites/default/files/DRD2-General-New-Construction-Spec-Sheet_7_0 .pdf , 9 pages.
Mar. 5, 2016—The DMF Lighting DRD2 Recessed LED Downlight General Retrofit Junction Box—Wet Location Rated is the ideal solution for Commercial LED recessed lighting retrofit applications. web cache https://www.alconlighting.com/dmf-drd2m.html (downloaded Jul. 28, 2018), 6 pages.
Ex Parte Quayle Office Action mailed Oct. 16, 2018 forU.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (MAGAZINE). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) ½ in. & (2) ¾ in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUIypJc0K80UHdDTI9C5m4BDzR3U87PRYV1NdQ1BFxEWQ2I_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Appl. No. 16/886,365, 16 pages.
Civil Action No. 2:18-cv-07090. Complaint for Infringement and Unfair Competition. *DMF, Inc.* v. *Amp Plus, Inc.* d/b/a *Elco Lighting*. 52 pages. Dated Aug. 15, 2018.
Petition for Inter Partes Review of U.S. Pat. No. 9,964,266 Pursuant to 37 C.F.R. § 42.100 et seq. AMP Plus Inc. dbd *Elco Lighting* v. *DMF, Inc*, IPR2019-01094 filed May 17, 2019. 108 pages.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages.
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL- 8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.

(56) References Cited

OTHER PUBLICATIONS

IPR2019-01094 Exhibit 1013. Illuminating Engineering Society of North America, IES Lighting Handbook (John E. Kaufman and Howard Haynes eds., Application Volume 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("PIER LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting Research and Development: Multi-Year Program Plan (Apr. 2013) ("DOE 2013"). 89 pages.
Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc*. d/b/a *Elco Lighting et al* v. *DMF, Inc*. PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc*. dbd *ELCO Lighting* v. *DMF, Inc*, PTAB-IPR2019-01500 filed Aug. 14, 2019. 99 pages.
Docket Listing in Inter Partes Review of U.S. Pat. No. 9,964,266 . *AMP Plus, Inc*. d/b/a *ELCO Lighting et al* v. *DMF, Inc*. PTAB-IPR2019-01500. Downloaded Mar. 25, 2020. 3 pages.
Docket Listing in Civil Action No. 2:18-cv-07090. *DMF, Inc*. v. *AMP Plus, Inc*. d/b/a *Elco Lighting et al* CDCA-2-18-cv-07090. Downloaded on Mar. 25, 2020. 39 pages.
Civil Action No. 2:19-cv-4519.Complaint for Patent Infringement. *DMF, Inc*. v. *AMP Plus, Inc*. d/b/a *ELCO Lighting*. 52 pages dated May 22, 2019. 23 pages.
Docket Listing in Civil Action No. 2:19-cv-4519. *DMF Inc* v. *AMP Plus, Inc*. d/b/a *ELCO Lighting et al* CDCA-2-19-cv-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant to 35 U.S.C. § 282 in Civil Action No. 2:18-cv-07090-CAS-GJS dated Feb. 28, 2020. 7 pages.
Defendant AMP Plus, Inc.'s Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to Dmf, Inc.'s Motion for Partial Summary Judgment in Civil Action No. 2:18-cv-07090-CAS-GJS filed Feb. 10, 2020. 210 pages.
Plaintiff DMF's Reply in Support of Motion for Partial Summary Judgment in Civil Action No. 2:18-cv-07090-CAS-GJS filed Feb. 18, 2020. 33 pages.
Declaration of James R. Benya in Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 LED Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree® XLamp® LEDs. Cree Application Note. 2004. 19 pages.
Imtra Marine Lighting Fall 2007 Catalog. 32 pages.
U.S. Appl. No. 15/637,742, filed Jun. 29, 2017, Kopitzke, IV.
U.S. Appl. No. 15/688,266, filed Aug. 28, 2017, Lofti et al.
U.S. Appl. No. 15/853,400, filed Dec. 22, 2017, Kashani.
U.S. Appl. No. 15/901,738, filed Feb. 21, 2018, Danesh.
U.S. Appl. No. 15/947,065, filed Apr. 6, 2018, Danesh.
U.S. Appl. No. 16/016,040, filed Jun. 22, 2018, Danesh.
U.S. Appl. No. 16/200,393, filed Nov. 26, 2018, Danesh.
U.S. Appl. No. 29/638,259, filed Feb. 26, 2018, Danesh.
U.S. Appl. No. 29/541,565, filed Oct. 5, 2015, Peng.
U.S. Appl. No. 29/645,941, filed Apr. 30, 2018, Danesh et al.
U.S. Appl. No. 29/653,142, filed Jun. 11, 2018, Danesh et al.
U.S. Appl. No. 29/664,471, filed Sep. 25, 2018, Danesh et al.
U.S. Appl. No. 29/678,478, filed Jan. 29, 2019, Danesh et al.
U.S. Appl. No. 29/678,482, filed Jan. 29, 2019, Danesh et al.
U.S. Appl. No. 29/683,730, filed Mar. 15, 2019, Danesh et al.
U.S. Appl. No. 29/694,475, filed Jun. 11, 2019, Peng et al.
U.S. Appl. No. 16/653,497, filed Oct. 15, 2019, Danesh et al.
U.S. Appl. No. 29/711,198, filed Nov. 29, 2019, Danesh et al.
U.S. Appl. No. 16/690,970, filed Nov. 21, 2019, Nikooyan et al.
U.S. Appl. No. 16/719,361, filed Dec. 18, 2019, Danesh et al.
U.S. Appl. No. 16/522,275, filed Jul. 25, 201, Danesh.
U.S. Appl. No. 16/725,606, filed Dec. 23, 2019, Bailey et al.
U.S. Appl. No. 29/648,046, filed May 17, 2018, Williams.
U.S. Appl. No. 16/779,824, filed Feb. 3, 2020, Danesh.
U.S. Appl. No. 29/688,172, filed Apr. 18, 2019, Danesh et al.
U.S. Appl. No. 29/688,143, filed Apr. 18, 2019, Danesh et al.
*DMF, Inc*. v. *AMP Plus, Inc. d/b/a ELCO Lighting et al*, CDCA-2-18-cv-07090.
*DMF Inc* v. *AMP Plus, Inc d/b/a ELCO Lighting et al*, CDCA-2-19-cv-04519.
*AMP Plus, Inc. d/b/a Elco Lighting et al* v. *DMF, Inc*. PTAB-IPR2019-01094; and.
*AMP Plus, Inc. d/b/a ELCO Lighting et al* v. *DMF, Inc*. PTAB-IPR2019-01500.
Notice of Allowance dated Apr. 9, 2020 from U.S. Appl. No. 16/653,497, 7 pages.
Notice of Allowance dated Sep. 8, 2020 from U.S. Appl. No. 29/678,482, 5 pages.
Corrected Notice of Allowance dated Sep. 11, 2020 from U.S. Appl. No. 16/719,361, 2 pages.
Canadian Office Action in Application No. 2931588 dated Aug. 13, 2020, 5 pages.

(56) References Cited

OTHER PUBLICATIONS

Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Notice of Allowance dated Oct. 27, 2020 from U.S. Appl. No. 29/648,046, 5 pages.
Notice of Allowance dated Oct. 27, 2020 from U.S. Appl. No. 29/694,475, 5 pages.
Notice of Allowance dated Nov. 10, 2020 from U.S. Appl. No. 29/688,143, 6 pages.
Notice of Allowance dated Nov. 10, 2020 from U.S. Appl. No. 29/688,172, 6 pages.
Non-Final Office Action dated Nov. 30, 2020 from U.S. Appl. No. 17/000,702, 7 pages.
Notice of Allowance dated Dec. 2, 2020 from U.S. Appl. No. 29/746,262, 6 pages.
International Search Report and Written Opinion in PCT/US2020/050767 dated Dec. 9, 2020, 25 pages.
Non-Final Office Action dated Dec. 16, 2020 from U.S. Appl. No. 17/080,080, 28 pages.
Canadian Office Action in Application No. 2941051 dated Dec. 8, 2020, 5 pages.
Final Office Action dated Jan. 11, 2021 from U.S. Appl. No. 15/688,266, 7 pages.
Non-Final Office Action dated Jan. 11, 2021 from U.S. Appl. No. 16/725,606, 7 pages.
Non-Final Office Action dated Jan. 13, 2021 from U.S. Appl. No. 17/085,636, 14 pages.
Notice of Allowance dated Jan. 15, 2021 from U.S. Appl. No. 17/000,702, 7 pages.
Notice of Allowance dated Jan. 22, 2021 from U.S. Appl. No. 17/080,080, 14 pages.
Notice of Allowance dated Jan. 22, 2021 from U.S. Appl. No. 16/886,365, 7 pages.
Final Office Action dated Feb. 5, 2021 from U.S. Appl. No. 16/200,393, 7 pages.
"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.
"Electrical Boxes Volume and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.
U.S. Appl. No. 61/881,162, filed Sep. 23, 2013. Prioirty application to US Publication No. 2015/0085500 to Cooper et al. 31 pages.
Non-Final Office Action dated Jan. 19, 2021 from U.S. Appl. No. 17/099,650, 15 pages.
Supplemental Notice of Allowance dated Mar. 10, 2021 from U.S. Appl. No. 16/886,365, 2 pages.
Notice of Allowance dated Apr. 6, 2021 from U.S. Appl. No. 16/200,393, 11 pages.
Non-Final Office Action dated Apr. 12, 2021 from U.S. Appl. No. 29/694,475, 11 pages.
Notice of Allowance dated Apr. 13, 2021 from U.S. Appl. No. 16/725,606, 7 pages.
Notice of Allowance dated Apr. 26, 2021 from U.S. Appl. No. 17/080,080, 11 pages.
Corrected Notice of Allowance dated Apr. 28, 2021 from U.S. Appl. No. 16/725,606, 2 pages.
Notice of Allowance dated May 5, 2021 from U.S. Appl. No. 17/085,636, 8 pages.
Notice of Allowance dated May 14, 2021 from U.S. Appl. No. 16/881,686, 8 pages.
Notice of Allowance dated May 17, 2021 from U.S. Appl. No. 15/688,266, 9 pages.
Notice of Allowance dated May 24, 2021 from U.S. Appl. No. 29/688,143, 6 pages.
Notice of Allowance dated May 24, 2021 from U.S. Appl. No. 29/688,172, 6 pages.
Notice of Allowance dated May 28, 2021 from U.S. Appl. No. 16/779,824, 11 pages.
Notice of Allowance dated Jun. 1, 2021 from U.S. Appl. No. 16/719,361, 7 pages.
Non-Final Office Action dated Jul. 14, 2021 from U.S. Appl. No. 17/118,742, 11 pages .
Notice of Allowance dated Jul. 21, 2021 from U.S. Appl. No. 17/318, 13 pages.
Supplemental Notice of Allowance dated Aug. 13, 2021 1 from U.S. Appl. No. 16/779,824, 3 pages.
Supplemental Notice of Allowance dated Aug. 19, 2021 1 from U.S. Appl. No. 17/318,193, 4 pages.
Notice of Allowance dated Aug. 20, 2021 1 from U.S. Appl. No. 29/764,875, 5 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant AMP Plus, Inc.'s Initial Disclosure and Designation of Expert Witnesses in Civil Action No. 2:19-CV-4519-CAS. 37 pages.
Defendant AMP Plus, Inc. D/B/A Elco Lighting's Supplemental Responses to Plaintiff DMF, Inc.'s First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
U.S. Appl. No. 16/883,144, filed May 26, 2020, Nikooyan et al.
U.S. Appl. No. 29/696,830, filed Jul. 1, 2019, Kopitzke.
U.S. Appl. No. 16/182,481, filed Nov. 6, 2018, Kopitzke.
U.S. Appl. No. 29/762,016, filed Dec. 14, 2020, Williams et al.
U.S. Appl. No. 17/118,742, filed Dec. 11, 2020, Danesh et al.
U.S. Appl. No. 29/752,046, filed Sep. 24, 2020, Peng et al.
U.S. Appl. No. 17/229,668, filed Apr. 13, 2021, Shen.
U.S. Appl. No. 17/318,193, filed May 12, 2021, Danesh et al.
U.S. Appl. No. 17/080,080, filed Oct. 26, 2020, Danesh.
U.S. Appl. No. 17/220,779, filed Apr. 1, 2021, Kopitzke et al.
U.S. Appl. No. 17/395,522, filed Aug. 6, 2021, Danesh.
U.S. Appl. No. 17/385,766, filed Jul. 26, 2021, Kopitzke.
U.S. Appl. No. 17/384,564, filed Jul. 23, 2021, Kopitzke et al.
U.S. Appl. No. 17/381,147, filed Jul. 20, 2021, Lofti et al.
U.S. Appl. No. 17/379,748, filed Jul. 19, 2021, Young et al.
U.S. Appl. No. 17/379,489, filed Jul. 19, 2021, Vinh et al.
U.S. Appl. No. 17/378,214, filed Jul. 16, 2021, Kopitzke et al.
U.S. Appl. No. 17/374,674, filed Jul. 13, 2021, Danesh.
U.S. Appl. No. 17/234,421, filed Apr. 19, 2021, Danesh.
U.S. Appl. No. 29/764,875, filed Jan. 4, 2021, Danesh et al.
U.S. Appl. No. 29/759,492, filed Nov. 23, 2020, Danesh et al.
U.S. Appl. No. 17/099,650, filed Nov. 16, 2020, Danesh et al.
U.S. Appl. No. 29/757,754, filed Nov. 9, 2020, Danesh et al.

Sectional view along B - B'

CASING FOR LIGHTING ASSEMBLY

CROSS-REFERENCE TO RELATED APPLICATIONS

This application is a Continuation Application of U.S. application Ser. No. 14/942,937, filed on Nov. 16, 2015, entitled "RECESSED LIGHTING ASSEMBLY," which is incorporated herein by reference in its entirety.

FIELD

An embodiment of the invention relates to a recessed lighting assembly that has a fire resistant casing, a light source module that is held inside the casing, and a trim attached to the casing. Other embodiments are also described.

BACKGROUND

Recessed lighting units are typically installed or mounted into an opening in a ceiling or a wall. Modern recessed lighting units generally consist of a trim, a light source module, a driver circuit, a legacy incandescent "can" in which the light source module and driver circuit are housed, a junction box, and a set of hangar bars to which a horizontally oriented frame or platform is directly attached. The can and junction box are attached to the horizontally oriented platform. The combination of the can and junction box attached to the horizontal platform is bulky and expensive to manufacture.

SUMMARY

An embodiment of the invention is a recessed lighting unit that advantageously obviates the need for a separate junction box that is dedicated to the recessed lighting unit, because the building electrical power network wires, that supply power to another nearby recessed lighting unit or that come from a nearby shared wire enclosure or junction box, are routed directly into the casing of the recessed lighting unit (for supplying power to a light source module inside the casing.) A further advantageous aspect is that the light source module (to which a trim has been attached, e.g., via a twist and lock mechanism) is positioned deeper inside a casing of the recessed lighting unit, thereby yielding improvements in the illumination provided by the module. The casing has a closed top end, and a side wall having a top edge which joins the closed top end, wherein the side wall extends downward from the closed top end and is curved so as to completely surround a cavity that is between the closed top end and an open bottom end of the casing that is defined by a bottom edge of the sidewall. The trim may be composed of a crown that has a frusto-conical shape, wherein the crown has a base with a base opening formed therein, and a top with a top opening formed therein. Light to be emitted from the module is to pass through the crown by passing through the top opening and then through the base opening before illuminating a room. A frustum extends from the base of the crown to its top. The trim also has a brim that is attached to the base and encircles the base opening. The brim will sit flush against a ceiling or wall behind which the casing is installed, e.g., attached to structural beam member of the building. To attach the trim to the light source module, a means is used for attaching the top of the crown to the light source module. The module is held in its deeper position inside the casing, by a means that is anchored to the frustum of the crown and that is for attaching to the sidewall of the casing. The crown is dimensioned to be tall enough such that when the light source module is attached to the top of the crown, the light source module is held entirely within the cavity of the casing (when the means anchored to the frustum of the crown is attached to the sidewall of the casing.)

In one embodiment, a holding bracket is provided that can slide vertically within the cavity of the casing. The bracket has two or more arms that extend upward from a frame, where each arm has a slot formed lengthwise in it and through which an attaching member extends; the attaching member is fixed to the sidewall of the casing, so that the arms can slide up and down while being guided by the attaching member through the slot. The light source module is attached to the frame of the bracket. The light source module receives electrical power from the building electrical system through high voltage wires that go into the casing and connect to the module; the bracket prevents the light source module from hanging only by these high voltage wires, in the event that the mechanism for attaching the trim to the sidewall of the casing becomes accidentally overloaded (thereby causing the trim and the attached light source module to fall out of the casing, where the casing is mounted behind a ceiling, under the pull of gravity). Also, the bracket may be designed to be short enough, e.g., its arms are short enough, to ensure that in its lowest position, the attached light source module does not hang so far below the casing as to freely give a user access to the high voltage wires inside the casing; with the bracket in its lowest position, the user should have to first detach the light source module from the bracket before being able to disconnect or connect the high voltage wires.

The bracket may be free to slide vertically downward, until a stop is reached which prevents the bracket from falling out of the casing (under the pull of gravity). The bracket may also be free to slide vertically upward; this enables the light source module, which is attached to the bracket, to be vertically moved upward into any desired recessed position inside the casing, e.g., by a user grasping and pushing the trim (to which the light source module is also attached) upward in the vertical direction, until the upper surface of the brim (of the trim) abuts a lower surface of the ceiling (a stop is reached.) In this manner, the holding bracket also allows trims of different depth (height) to be attached to the same light source module, while still being able to be positioned all the way up and flush against the ceiling.

The design of the recessed lighting unit can also easily accommodate irregularity in the thickness of the ceiling of a building, where some portions have greater thickness than others. The light source module is attached to the trim, but is other wise free to be pushed deeper into the casing as needed to accommodate a thicker ceiling condition. The mechanism for attaching the trim to the sidewall of the casing may include friction clips that are anchored to the crown portion of the trim; the friction clips are sufficiently strong to stay fixed in position against the sidewall of the casing despite the added weight of the light source module. By also providing a fire resistant casing, the recessed lighting unit eliminates the added bulk and size of traditional recessed lighting units that have a separate outer enclosure or fire box around the incandescent can.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment. In other words, there may be elements shown in a given figure that are optional, or unnecessary, for certain embodiments.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1A:
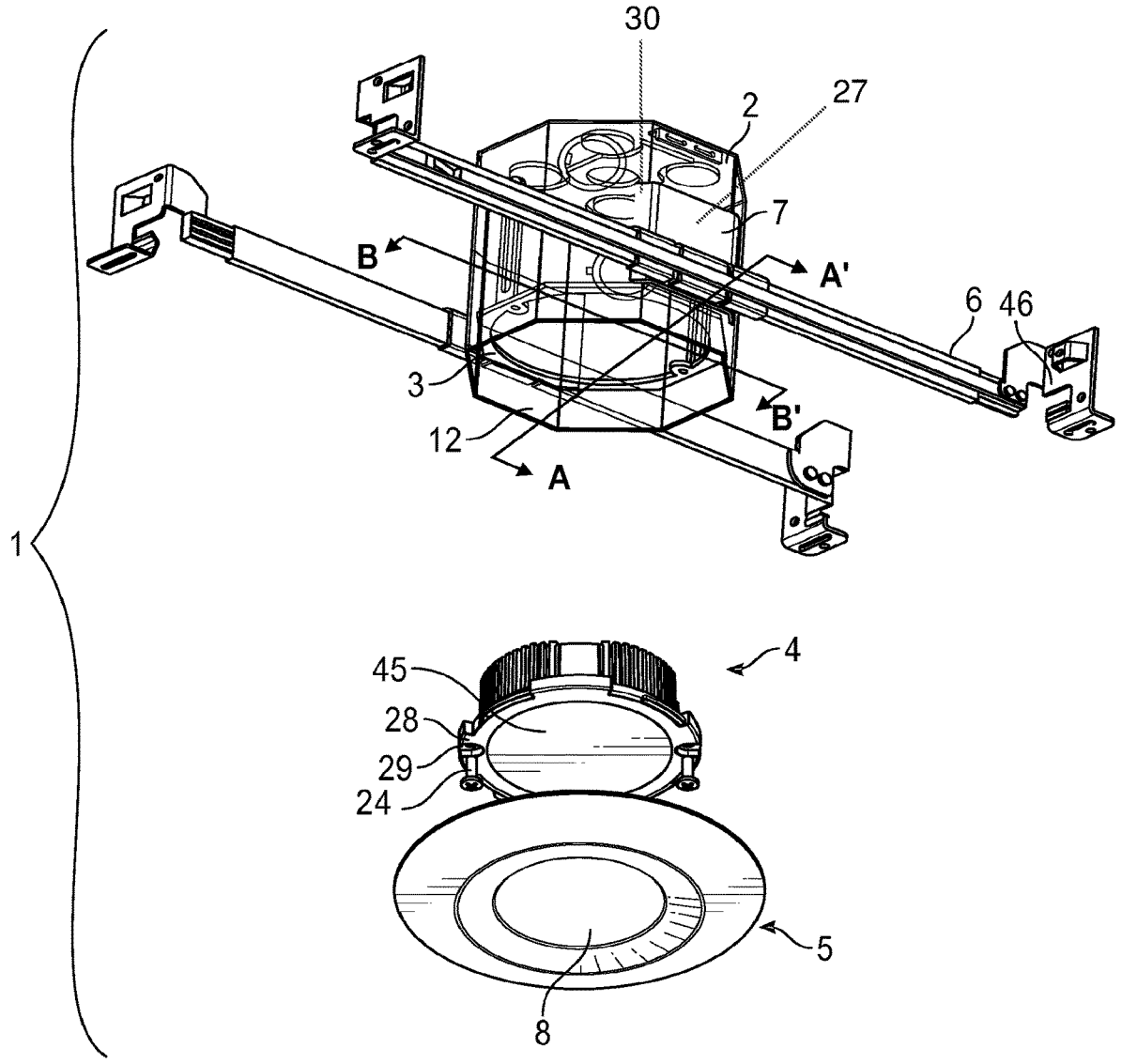
FIG. 1A shows a perspective view of a recessed lighting unit according to one embodiment.

FIG. 1A shows a perspective view of an embodiment of a recessed lighting unit 1, which may be installed within a wall or a ceiling. The recessed lighting unit 1 may include a casing 2, a holding bracket 3 (which may also be referred as a yoke) inside the casing 2, a light source module 4 inside the casing 2, a trim 5, hangar bars 6, and casing holders 7. The recessed lighting unit 1 is positioned behind a ceiling or a wall so that the casing 2 is aligned with a hole in the ceiling or wall (not shown) through which the room is illuminated by the module 4. The light source module 4 as will be described below in more detail is contained inside the casing 2. The trim 5 serves the primary purpose of covering the exposed edge of the ceiling or wall where the recessed lighting unit 1 resides and where the hole is formed, while still allowing light from the light source module 4 to be emitted into a room through a trim opening 8. The trim 5 may also serve to hide the bottom edge of the casing 2 from view. In doing so, the trim 5 helps the recessed lighting unit 1 appear seamlessly integrated into the ceiling or wall. The trim 5 is attached to the light source module 4 (e.g., via a twist and lock mechanism, for example, or a snap fit mechanism), and also directly to the casing 2 (e.g. via friction clips, tension clips (tension grips), or magnets). The section views of the recessed lighting unit in FIG. 2 and FIG. 3 show the assembly with the trim 5 attached to the light source module 4, where a top of the crown 38 of the trim 5 is abutting the front surface of a lens 45, where the latter has been fitted into position covering the bottom opening of the housing of the module 4.

The casing 2 of the present invention is advantageous in that it is compact, cost-effective, and fire resistant. The casing 2 obviates the need for a traditional junction box attached to an incandescent "can," which may be bulky and expensive. The casing 2 may be made of galvanized steel, injection molded plastic, or ceramic, which is also advantageous over the traditional, non-fire resistant incandescent can. The casing 2 may be fire-resistant in that it has a fire rating of up to two hours without any need for modification, where the fire rating is described in the National Electrical Code (NEC) and by the Underwriters Laboratories (UL) such as specified in UL 263 Standard for Fire Tests of Building Construction and Materials. The fixture may also be designed to attenuate airborne sound by the building partition (ceiling) in which it is installed; in one embodiment, the casing 2 can maintain a minimum Sound Transmission Class (STC) rating of 50; this alleviates the need for enclosing the casing 2 with any additional element in order to maintain a minimum 50 STC rating.

Figure 2:
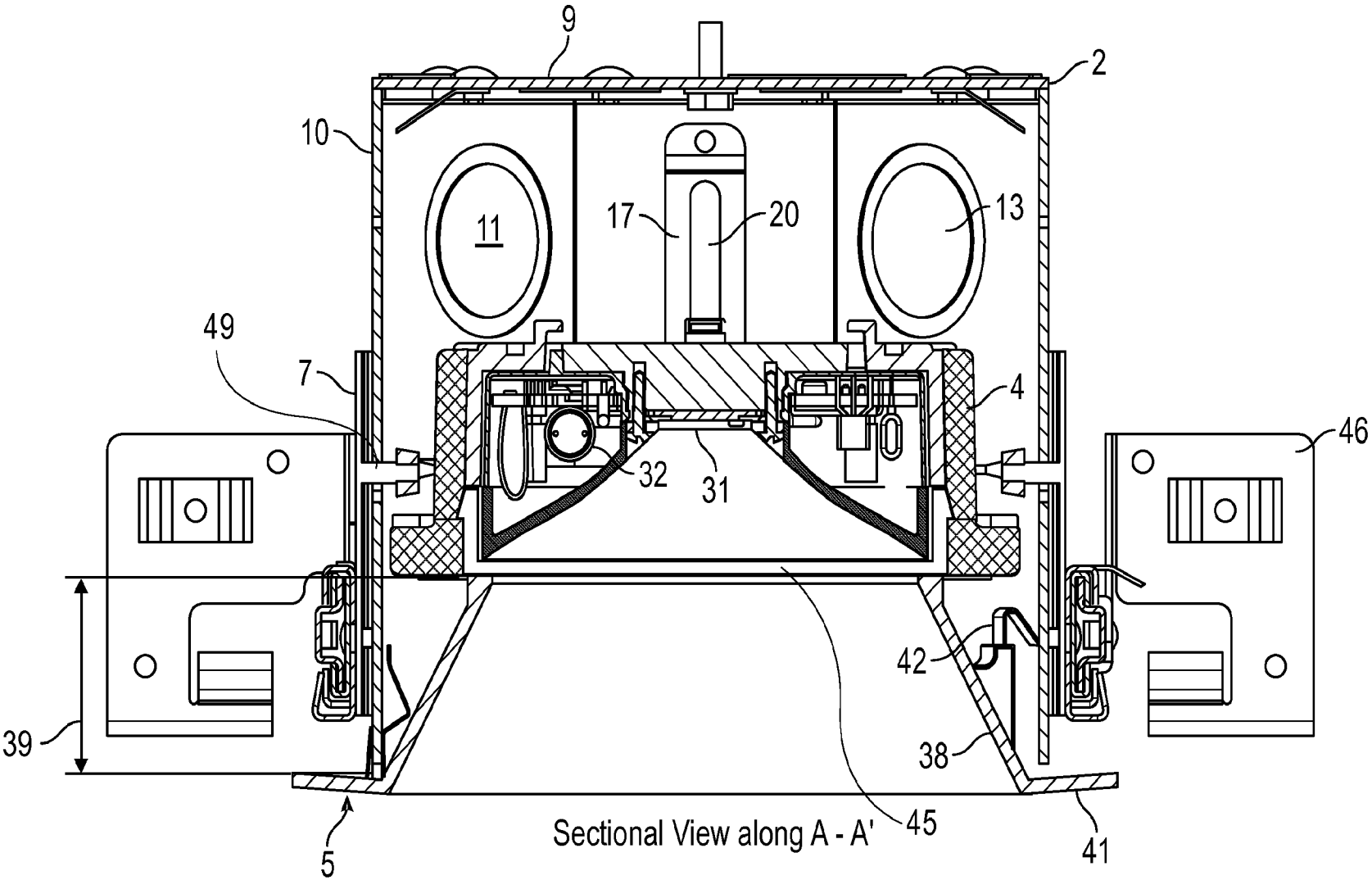
FIG. 2 shows a side cross section view of the embodiment of FIG. 1A along the cut A-A'.
Figure 3:
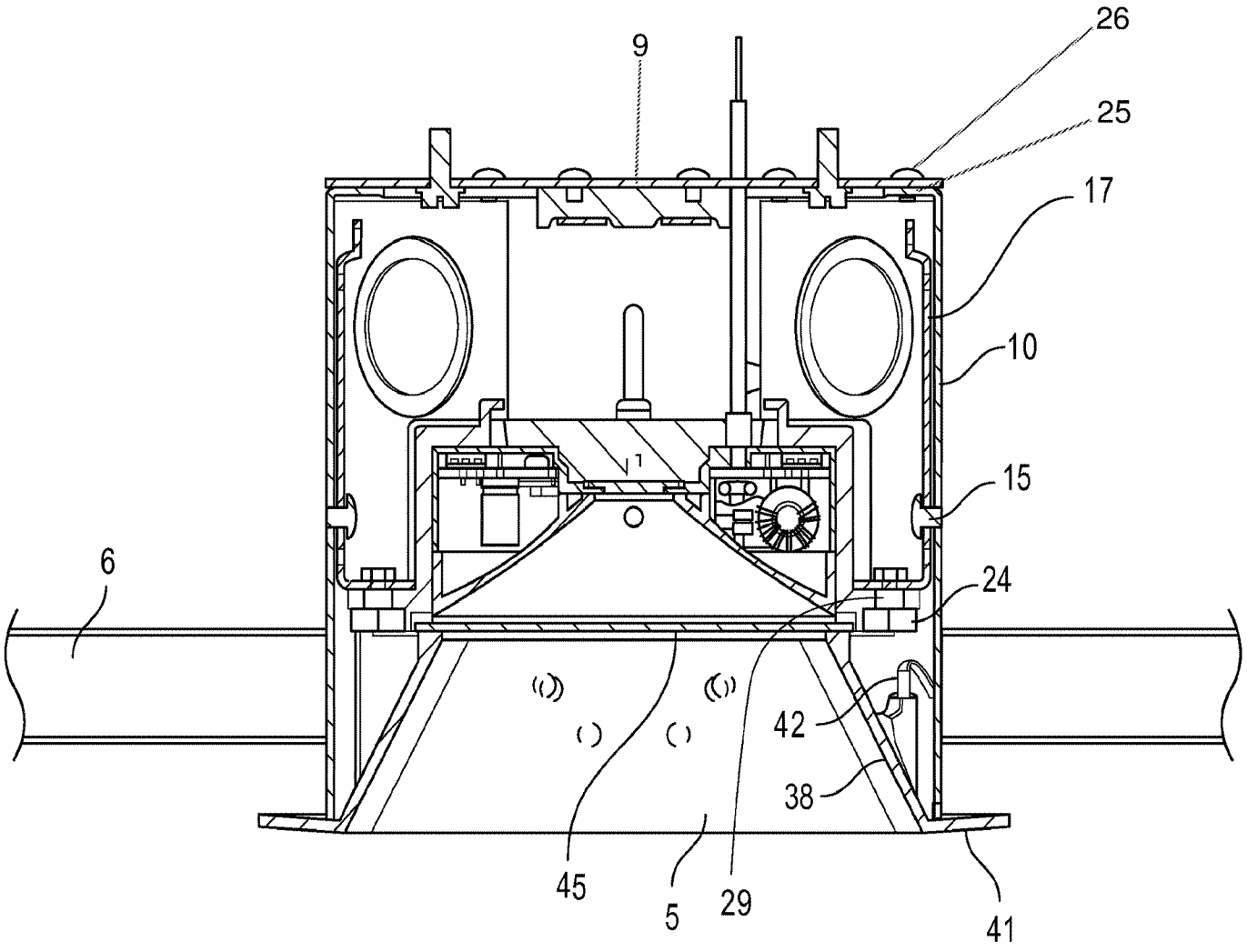
FIG. 3 shows a front cross section view of the embodiment of FIG. 1A along the cut B-B'.
Figure 5:
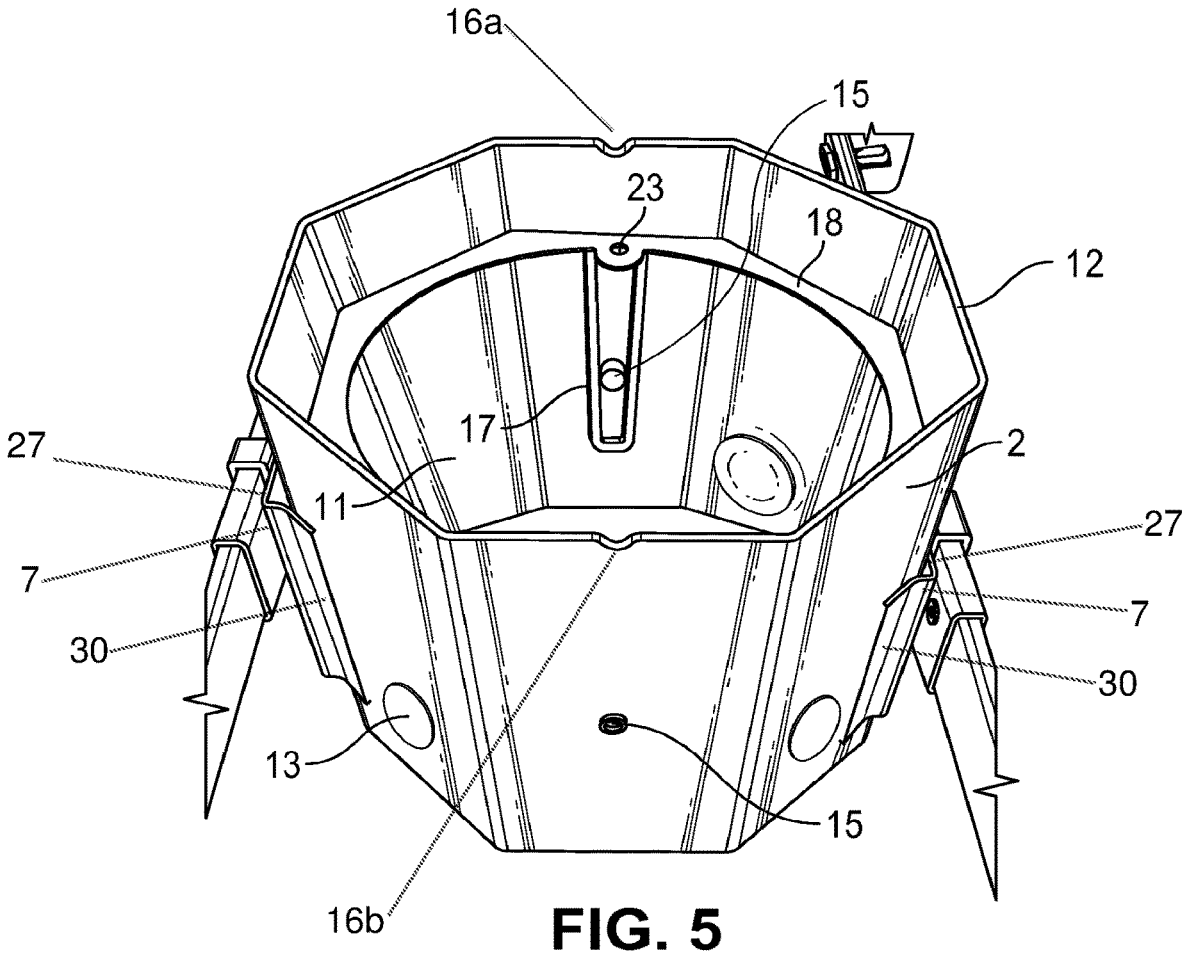
FIG. 5 shows a perspective looking into the cavity of the casing, through the opening.

In one embodiment, as shown in the section view of FIG. 2, the casing 2 may have a closed top end 9, and a side wall 10 that surrounds a cavity 11 and includes a bottom edge defining a bottom end opening 12. The bottom edge may include notches 16*a* and 16*b* as shown in FIG. 5. The closed top end 9 and the sidewall 10 may have one or more knockouts 13. The side wall 10 may include a top edge with a tab 25 which joins the closed top end 9 via, for example, a fastener 26 as shown in FIG. 3. A knockout 13 may be punched through and removed to leave an opening in the closed top end 9 or the side wall 10, for building electrical power wires (e.g. non-metallic sheathed cable, or to receive metal flexible conduit) to be inserted through the opening. A knockout 13 may also have a smaller opening in it (e.g., a slit, slot, etc., that is smaller than the opening that results when the knockout 13 has been removed from the closed top end 9 or the side wall 10) that may allow the installer to pry-out the knockout with a flathead screwdriver. The knockout 13 may be more than ½ inch in its smallest diameter (as its shape may be elliptical as shown, having a minor diameter and a major diameter). The casing 2 may have a horizontal cross section that is shaped as a polygon. For example, the horizontal cross section of the casing 2 may be square, rectangle, pentagon, hexagon, heptagon, octagon, nonagon, or decagon. The casing 2 may be made from a flat sheet of metal that is folded into a polygonal cylinder to form the sidewall 10. The casing 2 may also be ellipsoid, frusto-conical, or otherwise curved.

Figure 1B:
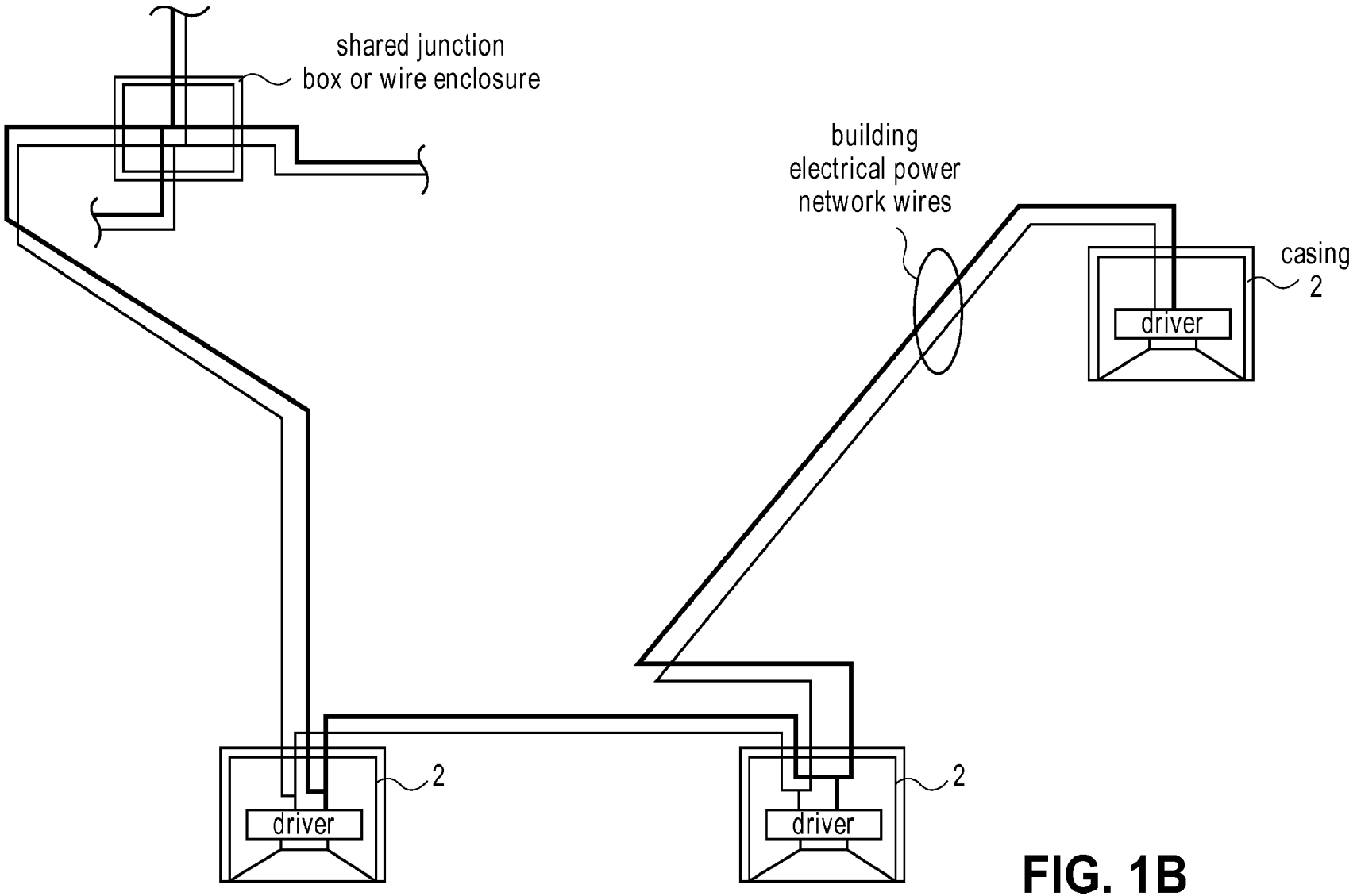
FIG. 1B depicts part an illumination network in which several of the recessed light units are connected directly without the use of dedicated junction boxes.

Held inside the light source cavity 11 is the light source module 4, which has a housing in which a light source 31 and a driver 32 are installed. The building electrical power wires that are routed into the casing 2 are connected to a set of driver wires that merge from the module 4, within the cavity 11. These electrical wires may be connected together through the use of interlocking connectors that may be contained within the cavity 11 of the casing 2. In other embodiments, the electrical wires may be coupled to each other through the use of electrical caps or other devices (inside the cavity 11 of the casing 2). When the wires are connected, electricity may pass from the building electrical power wiring network to the driver 32 to enable the driver 32 to power the light source 31 (and thereby illuminate the room). In one embodiment, where there is a network of such recessed lighting units 1 installed within a building, as depicted in FIG. 1B, the electrical wires that come into the casing 2 (through the knockout 13 for example) can be routed directly from their "adjacent" connection at another recessed lighting unit 2 (that may be installed behind the same ceiling or wall, or a nearby one in the same building.) In other words, the building electrical wires coming into the casing 2 (to supply power to operate the light source module) can be directly routed from the inside of another, nearby recessed lighting unit or from a shared junction box as shown in FIG. 1B. In other words, the casing 2 has two or more driver wires 33 that emerge from the light source module 4 (see FIG. 4) and that are electrically connected to the two or more building electrical power wires, respectively, inside the cavity 11 of the casing 2. This obviates the need to add a separate junction box to make such a connection, in part because the casing 2 is also fire-rated to be a protective housing for the connection between i) the driver wires that emerge from or terminate in the driver 32 and ii) the building wires that come into the casing 2 and that are directly connected to power another recessed lighting unit in the same building.

The driver 32 is an electronic circuit or device that supplies and/or regulates electrical energy to the light source 31 and thus powers the light source 31 to emit light. The driver 32 may be any type of power supply circuit, including one that delivers an alternating current (AC) or a direct current (DC) voltage to the light source 31. Upon receiving electricity, the driver 32 may regulate current or voltage to supply a stable voltage or current within the operating parameters of the light source 31. The driver 32 receives an input current from the building electrical power wiring network of the building or structure in which the recessed lighting unit 1 is installed, and may drop the voltage of the input current to an acceptable level for the light source 31 (e.g., from 120V-277V to 36V-48V).

The light source 31 may be any electro-optical device or combination of devices for emitting light. For example, the light source 31 may have one or more light emitting diodes (LEDs), organic light-emitting diode (OLEDs), or polymer light-emitting diode (PLEDs). The light source 31 receives electricity from the driver 32, as described above, such that the light source 31 can emit a controlled beam of light into a room or surrounding area of the recessed lighting unit 1 (as installed behind a ceiling or wall).

In one embodiment, the light source module 4 may also include a lens 45. The lens 45 may be formed to converge or diverge, or simply filter, the light emitted by the light source 31. The lens 45 may be a simple lens comprised of a single optical element or a compound lens comprised of an array of simple lenses (elements) with a common axis. In one embodiment, the lens 45 also provides a protective barrier for the light source 31 and shields the light source 31 from moisture or inclement weather. The lens 45 may be made of any at least partially transparent material, including glass and hard plastics, and may be sized and shaped to be snap fitted into position covering the main opening at the bottom of the module 4 as shown. In one embodiment, the lens 45, the light source 31, and the driver 32 are contained in a single indivisible unit, the light source module 4, to work in conjunction to focus and adjust light emitted by the light source 31.

The light source module 4 may, or may not, be attached to a trim 5. The trim 5 has a crown 38 (as seen in FIG. 2 and FIG. 3), also referred to here as an annular region, whose central opening 8 allows light from the light source module 4 to pass through and illuminate the room or environment beyond the wall or ceiling. A brim 41 may surround the base of the crown 38, serving to hide or cover an edge of the wall or ceiling in which a hole for emitting light into the room is formed. Although not shown, that edge may surround the sidewall of the casing 2 (once the lighting unit 1 has been installed.) The crown 38 may be frusto-conical around the opening 8, and its height (crown height 39) may be in the range of 1 inch to 2.5 inches measured vertically from a top surface of the brim 41 (that may abut the ceiling or wall) to a top of the crown 38. This may define the height of the trim 5; as mentioned above, trims of different height that are designed to be attached to the same light source module 4 and to the casing 2 can be used (interchangeably).

In one embodiment, the crown 38 may be pushed deep into the casing 2 so that the brim 41 comes into contact with (abuts or is flush against) the edge of the sidewall that defines the bottom opening 12 of the casing 2. In another embodiment, where the edge of the casing 2 might not be aligned flush with the bottom surface of the wall or ceiling (e.g., where the bottom opening 12 of the casing 2 lies above or behind of the wall or ceiling), the crown 38 is pushed into the casing 2 but cannot be as deep, even though the brim 41 is still flush with the wall or ceiling.

Figure 4:
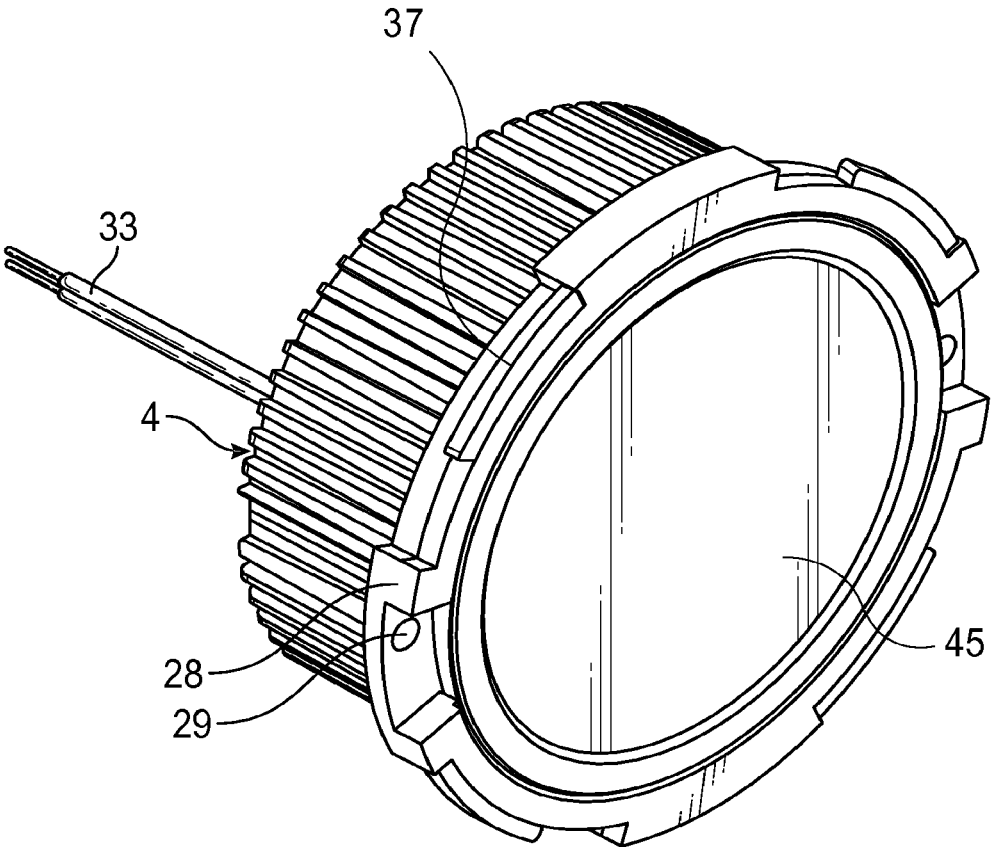
FIG. 4 shows a perspective view of a light source module.

In one embodiment, referring now to FIG. 4, the light source module 4 as shown therein may be rigidly attached to the trim 5 via a twist and lock mechanism. One half of the twist and lock mechanism being a bump or a hook that is formed at the top (of the crown 38) of the trim 5, while the other half is a tapered portion 37 that is formed on a lip 28 of the light source module 4; the user rotates the trim 5 and the module 4 relative to each other until the bump or hook of the trim 5 is aligned with the slot that is formed in the lip 28 next to the tapered portion 37 and then pushes the two parts towards each other while "twisting" so that the bump or hook and the tapered portion 37 engage each other until they are "locked" through friction. This provides a tool-free way to couple the trim 5 to the light source module 4. Other suitable means for attaching the top of the crown 38 to the light source module 4 may be possible, including a threaded fastener (e.g., screw, or a nut and bolt combination), a snap fit mechanism, a clip, an adhesive, and clamp that clamp the lip 28 to a flat top surface of the crown 38.

Returning to FIGS. 1A, 2, 3, once the trim 5 is attached to the light source module 4, and the electrical connection between the driver wires and the building wires inside the casing 2 has been made, the assembly of the light source module 4 and the trim 5 may be pushed upwards or inward into the cavity of the casing 2, through the hole in the ceiling or wall, until the brim 41 sits flush against the ceiling or wall. This may complete the installation of the recessed lighting unit 1.

Any suitable means for attaching the assembly of the light source module 4 and trim 5 to the sidewall of the casing can be used, in order to hold the trim 5 flush against the ceiling or wall. In one embodiment, as seen in the section view of FIG. 2, one or more friction clip 42 may be utilized to secure the assembly to the casing 2, which also allows the trim 5 to slide upward along the sidewall of the casing 2 as it is pushed by the user, to eventually lie flush against the ceiling or wall. As shown in the embodiment of FIG. 2, the friction clip 42 may be attached at its anchored end (via screw, bolt, resin, glue, or the like) to the crown 38 of the trim 5, while at their flexible or resilient end they will engage the sidewall of the housing 2. Alternatively, the friction clip 42 may be anchored to the light source module 4, or to a frame 18 of the holding bracket 3 as described below. As seen in the embodiment of FIG. 2, the friction clip 42 may be composed of a generally V-shaped piece (e.g., of metal) that is oriented upside down as shown, with one segment of the V being anchored to the top surface of the frustum of the crown 38 (the bottom surface of the crown serving to reflect the light emitted from the module 4 into the room) while the other segment of the V comes into direct frictional contact with the inner surface of the sidewall 10 of the casing 2. The stiffness (when squeezing the two segments of the V towards each other) of the clip 42 provides sufficient friction that overcomes the combined weight of the light source module 4 and the trim 5, thereby preventing the assembly from falling out of the casing 2 (e.g. under the force of gravity.) Other means for attaching the light source module-trim assembly to the casing 2 include the use of one or more magnets that may be fixed on the trim 5, or on the light source module 4, and that are attracted to the casing 2 through magnetic force to hold the assembly in the casing 2, while still allowing the assembly to be slid upwards by the user (until the trim lies flush against the ceiling.)

Figure 6:
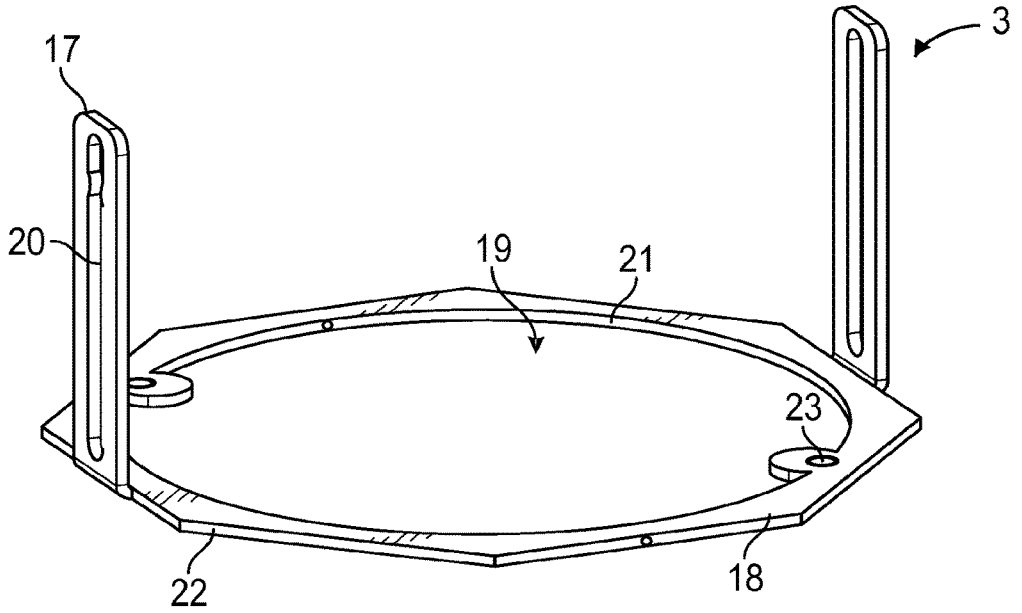
FIG. 6 shows a perspective view of a holding bracket.

Also shown in FIGS. 1A and 1*n* the section view of FIG. 3 is another embodiment of the invention, where a holding bracket 3 is added inside the cavity of the casing 2. A perspective view of the holding bracket 3 is shown in FIG. 6. The holding bracket 3 may be a separate piece than the casing 2, and is coupled to an attaching member 15 that is fixed in position onto the sidewall 10. The bracket 3 may have one or more arms 17 that extend upward from a frame 18 that has a frame opening 19 therein. In a preferred embodiment, there are two arms 17 that extend upward from the frame 18, but additional arms 17 may be provided. The bracket 3 may be initially formed from a flat sheet of metal, with the frame 18 and the arms 17 formed on a same plane. Subsequently, the arms 17 may be cut out and then bent upward in the same direction. Each arm 17 may have a slot 20 running along its length through which a respective attaching member 15 may be fitted. The attaching member 15 may be a screw, bolt, pin, rivet or any other structure that is capable of coupling with the arm 17, by extending through the slot 20 and being fixed to the sidewall 10. While so engaged to the attaching member 15, the arm 17 of the bracket 3 is slidable within the cavity 11, relative to the attaching member 15 and along its slot 20. There may be some friction between the slot 20 and the attaching member 15 that may prevent the bracket 3 from freely sliding downward (under the force of gravity alone.) To maintain a desired, and optionally, adjustable, spacing between the arm 17 and the sidewall, the attaching member 15 may be threaded so as to receive a corresponding nut (not shown). In that condition, the arm 17 is held within a desired spacing between the nut and the sidewall 10 of the casing 2. In one instance, the nut is received on the end of the attaching member 15 that is located inside the casing 2.

The holding bracket 3 may also be described as having multiple arms extending upward from the frame 18, where the frame 18 has a border that encloses a frame opening 19 as shown. The slot 20 is elongated, and runs along a length dimension of its respective arm 17. The attaching member 15 extends from the sidewall 10 into the cavity 11 of the casing 2, while passing through the slot 20, and is sized so as to couple the arm 17 to the sidewall 10 constraining translation of the arm 17 in the lateral direction but allowing pivoting of the arm 17 about the attaching member 15. The arm 17 has a surface that is facing the sidewall 10 and that is flat from one end to another end that is joined to the border of the frame 18. The arm 17 is slidable along the sidewall 10 between its innermost position and its outermost position within the cavity, wherein the outermost position of the arm is reached when its sliding is stopped by the attaching member 15.

Note that use of the bracket 3 is optional. When the bracket 3 is used, its frame 18 may be attached to the light source module 4, before the trim 5 is attached to the module 4. The arms of the bracket 3 and the slots therein should be long enough to allow the bracket 3 to slide deeper into the cavity 11, as needed to raise the trim 5 so that the brim 41 can lie flush against the ceiling or wall.

In one embodiment, when the bracket 3 is at its innermost (or uppermost) position inside the cavity 11, the bottom of the frame 18 may be within the range of 1 inch to 2.5 inch above the bottom edge of the sidewall of the casing 2 (that defines the bottom end opening 12 of the casing 2.) In one embodiment, when the bracket 3 is at its outermost (or lowermost) position, the bottom of the frame 18 may be in the range of 0 inch to ½ inch below the bottom edge of the sidewall of the casing 2. Also, when the bracket 3 is at its outermost position, there may be some play allowing the bracket 3 to pivot laterally (when the attaching members 15 are up against the uppermost end of the slots 20.) The bracket 3 also functions to prevent the light source module 4 (and the attached trim 5) from falling out of the casing 2, when the bracket has reached its outermost position; the attaching member 15 in that condition acts as a stop against the sliding arm 17, by abutting an inner top end of the arm that is defined by the slot.

As seen in FIG. 6, the frame 18 of the holding bracket 3 may have an inner edge 21 that is circular, oval, polygonal or curved. The frame 18 may have an outer edge 22 that is circular, oval, polygonal or curved. The outer edge 22 and the inner edge 21 may have different contours. In the embodiment shown in FIG. 5 for example, the outer edge 22 is polygonal while the inner edge 21 is circular. In a preferred embodiment, the outer edge 22 has the same number of sides as the casing 2, and the outer edge 22 conforms to the shape of the sidewall 10 of the casing 2. It is not necessary to have the outer edge 22 of the frame 18 that precisely conforms to the shape of the sidewall 10 of the casing 2. In one embodiment, the outer edge 22 may be oval or circular as long as the frame 18 fits inside the cavity 11 of the casing 2.

The frame 18 is attached to the light source module 4. As also seen in FIG. 3, the frame 18 may have an opening 23 that is configured to receive a corresponding attaching member 24, such as a screw, bolt, pin, or any other fastener piece that is capable of attaching the light source module 4 to the frame 18. As seen in FIG. 4, the light source module 4 may have a lip 28 that extends laterally outward from a base of the housing of the module 4, surrounding the base where the lens 45 is fitted (and from which light produced by the light source 31 emerges to illuminate the room below). One or more openings 29 may be formed on the lip 28 that correspond to and align with the openings 23 of the frame 18, when the housing of the module 4 has been inserted through the frame opening 19 of the frame 18, as depicted in FIG. 2. Once the bottom surface of the frame 18 abuts the top surface of the lip 28, a fastener (e.g., the attaching member 24 depicted in FIG. 1A), can be inserted through both openings and then can be fastened so as to secure the module 4 to the frame 18. In the embodiment shown in FIG. 6, there are two openings 23 formed in the frame 18 which correspond and align with to the two openings 29 that are formed in the lip 28 of the light source module 4 as seen in FIG. 4; the attachment of course can also be achieved at more than locations (with more than two fasteners).

In one embodiment, the recessed lighting unit 1 may include a set of hangar bars 6 as shown in FIG. 1 from which the casing 2 can be hung. The hangar bars 6 may be rigid, elongated members that are connected between adjacent joists and/or beams that are behind the walls or ceilings of the building (there may be two, positioned on opposite sides of the casing 2 as shown). In one embodiment, each of the hangar bars 6 may be telescoping such that the hangar bar 6 can be extended or retracted to meet the gap between the joists and/or beams.

In one embodiment, each of the hangar bars 6 may include mounting blocks 46 at its ends, which are the points at which the hangar bars 6 are attached to the joists and/or beams. For example, as shown in FIG. 1A, the mounting blocks 46 may include holes for receiving screws and/or nails or other fasteners that enable the hangar bars 6 to be securely attached to a building structure. Although shown in FIG. 1A and described above in relation to holes and screws, in other embodiments, other mechanisms of attachment may be used in conjunction with the mounting blocks 46, including resins, clips, or clamps to attached the bars 6 to the building structure. In one embodiment, a mounting block 46 may be integrated in one indivisible structure along with the hangar bar 6, while in other embodiments, as shown in FIG. 1A, the mounting blocks 46 may be coupled to the hangar bars 6 through the use of one or more attachment mechanisms (e.g., screws, bolts, resins, clips, or clamps). Using the telescoping and mounting features described above, the recessed lighting unit 1 may be installed in almost all of the typical 2"×2" through 2"×18" wood joist constructions, metal stud constructions, and t-bar ceiling constructions.

Still referring to FIG. 1A, in one embodiment, the recessed lighting unit 1 may have a mechanism for mounting the casing 2 to the hangar bars 6, that includes a set of casing holders 7 that couple the casing 2 to the hangar bars 6. As also seen in FIG. 2, the casing holder 7 may have a plate portion 27 that conforms to the polygonal shape of the sidewall and is secured to the sidewall 10 of the casing 2 by a nut and bolt/screw combination 49; if a slot is also formed in the sidewall 10 through which bolt/scree of the combination 49 passes, then the height of the casing 2 becomes adjustable relative to the hangar bars 6. Alternatively, the casing holder 7 may be attached to the sidewall via a clip, a clamp, a weld, or an adhesive resin. The casing holder 7 may have another portion 30 that is configured to wrap around but slide (or otherwise move) along the length of its corresponding, elongated hangar bar 6 (between the ends of the hangar bar 6.) The casing 2 may thus be moved along the hangar bars 6 to a desired location (e.g., at which the lens 45 of the light source module 4 will be directly above the opening in the ceiling or wall), and then it may be affixed to the hangar bars 6 once at the desired location, so that the casing holder 7 can no longer be moved relative to the hangar bars 6.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, as mentioned above, the light source module 4 need not be attached to the trim 5 (such as by a twist and lock mechanism or other attachment mechanism), if the module 4 is attached to the holding bracket 3; in that case, the module 4 can simply be pushed up into the casing 2, by the user gripping the trim 5 and aligning it so that the top of the crown 38 abuts the lip 28 of the module 4, and then pushing upward (until the brim 41 of the trim 5 abuts the ceiling or wall or other building partition, at which point the friction clips 42 should have been squeezed between the crown 38 and the sidewall 10 (thereby securing the trim 5 to the casing 2.) The description is thus to be regarded as illustrative instead of limiting.

The invention claimed is:

1. An apparatus, comprising:

a casing formed of injection molded plastic, the casing comprising:

a sidewall surrounding a cavity having a vertical height and adapted to contain a light source module in the cavity, the sidewall having an edge defining an opening; and a closed top end coupled to the sidewall and at an opposite end of the cavity from the opening, the closed top end including a first plurality of wiring passageways, wherein the vertical height of the cavity of the casing is sufficiently large to contain:

all of the light source module;

a substantial portion of a crown of a trim coupled to the light source module;

at least a portion of a first pair of building electrical power wires to supply power to the light source module; and at least a portion of a second pair of building electrical power wires to supply the power to another light source module of a nearby lighting unit.

2. The apparatus of claim 1, wherein:

the sidewall includes a second plurality of wiring passageways;

at least a first wiring passageway of the second plurality of wiring passageways is positioned on the sidewall proximate to the closed top end; and the vertical height of the cavity of the casing is sufficiently large such that when the light source module is completely contained in the cavity and the substantial portion of the crown of the trim coupled to the light source module is contained in the cavity, the light source module and the trim are below the first wiring passageway and do not obstruct the first wiring passageway.

3. The apparatus of claim 2, wherein the vertical height of the cavity of the casing is sufficiently large to accommodate a crown vertical height of the substantial portion of the crown of the trim in a range of from 1 inch to 2.5 inches.

4. The apparatus of claim 1, further comprising:

the light source module disposed in the cavity of the casing, the light source module comprising:

a housing;

a light source, disposed within the housing, having one or more light emitting diodes (LED's) to emit light; and a driver, coupled to the housing, to receive the power and to regulate electrical energy to the light source.

5. The apparatus of claim 4, further comprising:

at least the portion of the first pair of building electrical power wires to supply the power to the light source module from either an electrical power wiring network of a building or another lighting unit.

6. The apparatus of claim 5, further comprising:

at least the portion of the second pair of building electrical power wires.

7. The apparatus of claim 5, wherein the first pair of building electrical power wires is either a metal flexible conduit or a non-metallic sheathed cable.

8. The apparatus of claim 1, further comprising:

a holding bracket, disposed in the cavity of the casing, having an arm with a slot; and an attaching member, coupled to the sidewall of the casing, that passes through the slot of the arm such that the holding bracket is slidably adjustable relative to the cavity along the slot.

9. The apparatus of claim 8, further comprising:

the light source module coupled to the holding bracket such that the light source module moves with the holding bracket as the holding bracket is slidably adjusted; and at least the portion of the first pair of building electrical power wires to supply the power to the light source module, wherein the light source module is located between a first position where the light source module is disposed inside the cavity of the casing and a second position where a portion of the light source module is disposed outside the cavity of the casing such that the light source module still covers the opening of the sidewall thereby preventing access to the first pair of building electrical power wires.

10. The apparatus of claim 9, wherein the holding bracket at the first position is pivotable about the attachment member.

11. The apparatus of claim 1, further comprising:

a first hangar bar, slidably coupled to the casing, having a first mounting block; and a second hangar bar, slidably coupled to at least one of the first hanger bar and the casing and telescopically slidable with respect to the first hangar bar, having a second mounting block, wherein the first mounting block and the second mounting block include one or more attachment mechanisms to couple to at least one of a wood joist or a t-bar.

12. The apparatus of claim 11, further comprising:

the light source module disposed in the cavity of the casing, the light source module comprising:

a housing; and a light source, disposed within the housing, having one or more light emitting diodes (LED's) to emit light; and a driver to receive the power and to regulate electrical energy to the light source.

13. The apparatus of claim 12, further comprising the trim coupled to the light source module, wherein a crown vertical height of the substantial portion of the crown of the trim is in a range of from 1 inch to 2.5 inches.

14. The apparatus of claim 1, further comprising:

a casing holder directly coupled to the sidewall and not coupled to the closed top end such that at least a portion of the casing holder is slidably adjustable with respect to the casing.

15. The apparatus of claim 14, wherein:

the casing holder comprises a plate portion that conforms to a shape of the sidewall such that at least the portion of the casing holder is only slidably adjustable with respect to the casing.

16. The apparatus of claim 14, further comprising:

a first hangar bar, slidably coupled to the casing holder, having a first mounting block; and a second hangar bar, slidably coupled to the casing holder and telescopically slidable with respect to the first hangar bar, having a second mounting block, wherein the first mounting block and the second mounting block include one or more attachment mechanisms to couple to at least one of a wood joist or a t-bar.

17. The apparatus of claim 16, wherein:

the first hangar bar is telescopically slidable with respect to the second hangar bar along a first axis; and at least the portion of the casing holder is slidably adjustable with respect to the casing along a second axis; and the second axis is not parallel with the first axis.

18. The apparatus of claim 16, further comprising:

the light source module disposed in the cavity of the casing, the light source module comprising:

a housing; and a light source, disposed within the housing, having one or more light emitting diodes (LED's) to emit light; and a driver to receive the power and to regulate electrical energy to the light source.

19. The apparatus of claim 18, further comprising the trim coupled to the light source module, wherein a crown vertical height of the substantial portion of the crown of the trim is in a range of from 1 inch to 2.5 inches.

20. The apparatus of claim 14, further comprising:

a bolt/screw combination coupled to the casing holder and inserted through a sidewall opening in the sidewall of the casing; and a nut, disposed within the cavity of the casing and coupled to the bolt/screw combination, to prevent relative movement between the casing holder and the casing when the nut is sufficiently tightened.

21. The apparatus of claim 14, wherein the casing holder is coupled to the sidewall via a single bolt/screw combination.

22. The apparatus of claim 1, wherein at least a portion of the sidewall has a substantially octagonal cross section.

23. The apparatus of claim 1, further comprising a plurality of knockouts disposed on the sidewall and the closed top end.

24. The apparatus of claim 23, wherein each knockout in the plurality of knockouts is substantially circular in shape with a diameter greater than 0.5 inches.

25. The apparatus of claim 23, wherein:

the sidewall comprises a plurality of sides forming a substantially octagonal cross section; and each side in the plurality of sides includes either no knockout or only one knockout of the plurality of knockouts.

26. The apparatus of claim 1, wherein:

the sidewall of the casing includes a first side and a second side located diametrically opposite from the first side; and the first side and the second side each include a notch formed along a portion of the first edge of the sidewall.

27. The apparatus of claim 1, wherein the casing has a fire rating of up to two hours.

28. An apparatus, comprising:

a casing formed of injection molded plastic, the casing comprising:

a sidewall surrounding a cavity and adapted to contain a light source module and building electrical power wires in the cavity, the sidewall having a first end and a second end, the first end having an edge defining an opening; and a closed top end, coupled to the sidewall, to cover the second end of the sidewall; and a casing holder directly coupled to the sidewall and not coupled to the closed top end such that the casing holder is slidably adjustable with respect to the casing and not rotatably adjustable with the respect to the casing.

29. The apparatus of claim 28, wherein:

the casing holder comprises a plate portion that conforms to a shape of the sidewall such that the casing holder is only slidably adjustable with respect to the casing.

30. The apparatus of claim 29, further comprising:

a first hangar bar, slidably coupled to the casing holder, having a first mounting block; and a second hangar bar, slidably coupled to the casing holder and telescopically slidable with respect to the first hangar bar, having a second mounting block, wherein the first mounting block and the second mounting block include one or more attachment mechanisms to couple to at least one of a wood joist or a t-bar.

31. The apparatus of claim 28, further comprising:

a bolt/screw combination coupled to the casing holder and inserted through a sidewall opening in the sidewall of the casing; and a nut, disposed within the cavity of the casing and coupled to the bolt/screw combination, to prevent relative movement between the casing holder and the casing when the nut is sufficiently tightened.

32. The apparatus of claim 28, wherein the casing holder is coupled to the sidewall via a single bolt/screw combination.

33. The apparatus of claim 28, further comprising:

a plurality of knockouts disposed on the closed top end, each knockout in the plurality of knockouts is substantially circular in shape with a diameter greater than 0.5 inches.

34. An apparatus, comprising:

a casing to contain a plurality of building electrical power wires, the casing comprising:

a sidewall surrounding a cavity and having a substantially regular octagonal cross section, the sidewall having a first edge at least partially defining a first opening at a first end of the cavity and a second edge at least partially defining a second opening at a second end of the cavity;

a closed top end, coupled to the sidewall, to cover the second opening at the second end of the cavity, the closed top end having a shape that substantially conforms with the octagonal cross section of the sidewall;

a plurality of knockouts disposed on the sidewall and the closed top end; and a frame disposed in the cavity and accessible via the first opening at the first end of the cavity, the frame having an inner edge and a frame opening surrounded by the inner edge of the frame, wherein the inner edge is circular, oval, or curved.

35. The apparatus of claim 34, wherein the casing is formed of galvanized steel.

36. The apparatus of claim 34, wherein:

the sidewall of the casing includes a tab joined to the second edge; and the closed top end is coupled to the sidewall by a fastener inserted through respective openings in the closed top end and the tab.

37. The apparatus of claim 34, wherein each knockout in the plurality of knockouts is substantially circular in shape with a diameter greater than 0.5 inches.

38. The apparatus of claim 34, wherein:

the sidewall comprises a plurality of sides forming the substantially regular octagonal cross section; and each side in the plurality of sides includes either no knockouts or only one knockout in the plurality of knockouts, wherein the one knockout is disposed proximate to the second edge of the sidewall.

39. The apparatus of claim 34, wherein:

the sidewall of the casing includes a first side and a second side located diametrically opposite from the first side; and the first side and the second side each include a notch formed along a portion of the first edge of the sidewall.

40. The apparatus of claim 34, further comprising:

a light source module disposed in the frame opening; and a trim, coupled to the light source module via a screw fastener and coupled to the casing via one or more friction clips, to cover the first opening of the casing.

41. The apparatus of claim 40, wherein the trim includes a crown with a central opening through which light from the light source module passes upon exiting the casing, wherein a substantial portion of the crown is disposed in the cavity of the casing.

42. The apparatus of claim 34, further comprising:

the plurality of building electrical power wires to supply electric current with a voltage ranging from 120V to 277V, the plurality of building electrical power wires being either a conduit or a non-metallic sheathed cable.

43. The apparatus of claim 34, wherein the sidewall includes a sidewall opening on one side of the sidewall, and wherein the apparatus further comprises:

a casing holder;

a bolt/screw combination coupled to the casing holder and inserted through the sidewall opening; and a nut, coupled to the bolt/screw combination of the casing holder and disposed in the cavity of the casing, to prevent relative movement between the casing holder and the casing when the nut is sufficiently tightened.

44. The apparatus of claim 38, further comprising:

a first hangar bar, slidably coupled to the casing holder, having a first mounting block; and a second hangar bar, slidably coupled to the casing holder and telescopically slidable with respect to the first hangar bar, having a second mounting block, wherein the first mounting block and the second mounting block include one or more attachment mechanisms to couple to at least one of a wood joist or a t-bar.

45. The apparatus of claim 38, wherein:

the first hangar bar is telescopically slidable with respect to the second hangar bar along a first axis; and the casing holder is slidably adjustable with respect to the casing along a second axis when the nut coupled to the bolt/screw combination of the casing holder is sufficiently loosened; and the second axis is not parallel with the first axis.

46. The apparatus of claim 34, wherein the sidewall is formed from a sheet of metal.

47. The apparatus of claim 34, wherein the casing has a fire rating of up to two hours.

48. The apparatus of claim 34, wherein the cavity of the sidewall has a vertical height that is sufficiently large such that when a light source module is completely contained in the cavity and a substantial portion of a crown of a trim coupled to the light source module is contained in the cavity, the light source module and the trim are below the plurality of knockouts and do not obstruct the plurality of knockouts.

49. The apparatus of claim 48, wherein a crown vertical height of the substantial portion of the crown of the trim is in a range of from 1 inch to 2.5 inches.

50. An apparatus, comprising:

a casing having a cavity to contain a light source module, the casing comprising:

a sidewall surrounding the cavity and having an octagonal horizontal cross section, the sidewall comprising:

a bottom edge defining a bottom end opening through which light emitted by the light source module exits the housing;

a top edge defining a top end opening;

a first sidewall opening on a first side of the sidewall;

a second sidewall opening on a second side of the sidewall located diametrically opposite from the first side;

a tab, joined to the top edge of the sidewall, having a flat portion covering a portion of the top end opening;

a closed top end, coupled to the sidewall via a fastener inserted through a first fastener opening in the closed top end and a second fastener opening in the tab of the sidewall, to enclose the top end opening by covering the top edge of the sidewall, the closed top end having a shape that substantially conforms with the octagonal horizontal cross section of the sidewall; and a plurality of knockouts disposed on the sidewall and the closed top end, the plurality of knockouts comprising:

a first knockout disposed on a fifth side of the sidewall proximate to the top edge of the sidewall;

a second knockout disposed on a sixth side of the sidewall proximate to the top edge of the sidewall, the sixth side being located diametrically opposite from the fifth side of the sidewall;

a third knockout disposed on a seventh side of the sidewall proximate to the top edge of the sidewall; and a fourth knockout disposed on the closed top end, wherein:

each knockout in the plurality of knockouts is substantially circular in shape with a diameter greater than 0.5 inches; and the casing is formed of galvanized steel.

51. The apparatus of claim 50, wherein the sidewall further comprises:

a first notch on a portion of the bottom edge corresponding to a third side of the sidewall; and a second notch on a portion of the bottom edge corresponding to a fourth side of the sidewall located diametrically opposite from the third side.

52. The apparatus of claim 50, wherein the sidewall is formed from a sheet of metal.

53. The apparatus of claim 50, wherein the casing has a fire rating of up to two hours.

54. The apparatus of claim 50, further comprising:

the light source module, disposed in the cavity of the casing, having a lens to diverge the light;

a trim, coupled to the light source module via a threaded fastener and to the casing via one or more friction clips, to cover the bottom edge of the sidewall; and at least one of a conduit or a non-metallic sheathed cable, fed through an opening on the sidewall or the closed top end formed by the removal of a knockout in the plurality of knockouts, to supply an electric current with a voltage ranging from 120V to 277V to power the light source module.

55. The apparatus of claim 50, further comprising:

a first hangar bar assembly coupled to the sidewall of the casing, the first hangar bar assembly comprising:

a first casing holder, coupled to the first side of the sidewall via a first bolt/screw combination inserted through the first sidewall opening, the first bolt/screw combination being secured to the sidewall via a first nut coupled to the first bolt/screw combination, the first nut being disposed in the cavity of the casing; and a first pair of telescopically slidable hangar bars slidably coupled to the first casing holder, each hangar bar in the first pair of telescopically slidable hangar bars having a mounting block; and a second hangar bar assembly coupled to the sidewall of the casing, the second hangar bar assembly comprising:

a second casing holder, directly coupled to the second side of the sidewall via a second bolt/screw combination inserted through the second sidewall opening, the second bolt/screw combination being secured to the sidewall via a second nut coupled to the second bolt/screw combination, the second nut being disposed in the cavity of the casing; and a second pair of telescopically slidable hangar bars slidably coupled to the second casing holder, each hangar bar in the second pair of telescopically slidable hangar bars having a mounting block, wherein:

the first casing holder and the second casing holder are vertically adjustable with respect to the casing;

the first casing holder and the second casing holder are physically decoupled such that vertical movement of the first casing holder with respect to the casing does not cause the second casing holder to vertically move with respect to the casing; and each mounting block in the first and second pairs of telescopically slidable hangar bars has attachment mechanisms to couple to at least one of a wood joist or a t-bar.

56. The apparatus of claim 50, wherein the cavity of the sidewall has a vertical height that is sufficiently large such that when a light source module is completely contained in the cavity and a substantial portion of a crown of a trim coupled to the light source module is contained in the cavity, the light source module and the trim are below the plurality of knockouts and do not obstruct the plurality of knockouts.

57. The apparatus of claim 56, wherein a crown vertical height of the substantial portion of the crown of the trim is in a range of from 1 inch to 2.5 inches.

* * * * *